US011195469B2

(12) United States Patent
Kang et al.

(10) Patent No.: US 11,195,469 B2
(45) Date of Patent: Dec. 7, 2021

(54) STAGE FOR A DISPLAY DEVICE AND SCAN DRIVER HAVING THE SAME

(71) Applicant: Samsung Display Co., Ltd., Yongin-si (KR)

(72) Inventors: Chul Kyu Kang, Yongin-si (KR); Sung Hwan Kim, Yongin-si (KR); Soo Hee Oh, Yongin-si (KR); Dong Sun Lee, Yongin-si (KR); Sang Moo Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/708,344

(22) Filed: Dec. 9, 2019

(65) Prior Publication Data

US 2020/0211467 A1 Jul. 2, 2020

(30) Foreign Application Priority Data

Dec. 28, 2018 (KR) ..... 10-2018-0172287

(51) Int. Cl.
*G09G 3/30* (2006.01)
*G09G 3/36* (2006.01)
(Continued)

(52) U.S. Cl.
CPC ..... *G09G 3/3266* (2013.01); *G09G 3/3233* (2013.01); *G09G 3/3291* (2013.01);
(Continued)

(58) Field of Classification Search
CPC ..... G09G 3/007; G09G 3/30; G09G 3/3291; G09G 3/3266; G09G 3/3611–3696;
(Continued)

(56) References Cited

U.S. PATENT DOCUMENTS

2008/0100560 A1* 5/2008 Na ..... G09G 3/3677 345/101
2011/0044423 A1* 2/2011 Lin ..... G09G 3/32 377/64

(Continued)

FOREIGN PATENT DOCUMENTS

KR 10-2020-0066482 6/2020

*Primary Examiner* — Sanghyuk Park
(74) *Attorney, Agent, or Firm* — H.C. Park & Associates, PLC

(57) ABSTRACT

A stage of a scan driver for a display device, the stage includes: an output unit to output to an output terminal either a signal supplied to a first clock terminal corresponding to voltage of a first driving node or a voltage of a second power source corresponding to voltage of a second driving node; an input unit to control the voltage of the first driving node corresponding to signals supplied to a first input terminal, and the input unit to control the voltage of the second driving node corresponding to signals supplied to a second input terminal and a second clock terminal; a first signal processor including a second capacitor coupled between the second driving node and a second node, the first signal processor to control the voltage of the second driving node corresponding to signals supplied to a third clock terminal and a fourth clock terminal, the first signal processor to control a potential difference between both ends of the second capacitor corresponding to the signal supplied to the fourth clock terminal; and a second signal processor to control the voltage of the first driving node corresponding to the signal supplied to the first clock terminal.

20 Claims, 15 Drawing Sheets

(51) Int. Cl.
*G09G 3/3266* (2016.01)
*G09G 3/3291* (2016.01)
*G09G 3/3233* (2016.01)

(52) U.S. Cl.
CPC ..... *G09G 2310/0202* (2013.01); *G09G 2310/0278* (2013.01); *G09G 2310/0286* (2013.01); *G09G 2310/08* (2013.01)

(58) Field of Classification Search
CPC ... G09G 2300/0838; G09G 2300/0871; G09G 2310/02–0216; G09G 2310/024; G09G 2310/0262–0283; G09G 2310/0286–0289; G09G 2310/06–067
See application file for complete search history.

(56) References Cited

U.S. PATENT DOCUMENTS

| | | | | |
|---|---|---|---|---|
| 2012/0038616 | A1* | 2/2012 | Song | G09G 3/003 345/212 |
| 2012/0139881 | A1* | 6/2012 | Kwon | G09G 3/3677 345/204 |
| 2015/0091783 | A1* | 4/2015 | Hwang | G09G 3/20 345/55 |
| 2016/0035262 | A1* | 2/2016 | Lee | G09G 3/3266 345/690 |
| 2018/0330673 | A1 | 11/2018 | Kang et al. | |
| 2020/0175913 | A1 | 6/2020 | Kang et al. | |

* cited by examiner

<HIGH FREQUENCY DRIVING>

<LOW FREQUENCY DRIVING 1>

<LOW FREQUENCY DRIVING 2>

STAGE FOR A DISPLAY DEVICE AND SCAN DRIVER HAVING THE SAME

CROSS REFERENCE TO RELATED APPLICATION

This application claims priority from and the benefit of Korean Patent Application No. 10-2018-0172287, filed on Dec. 28, 2018, which is hereby incorporated by reference for all purposes as if fully set forth herein.

BACKGROUND

Field

Exemplary implementations of the invention relate generally to a display device, and more particularly, to a stage and a scan driver having the same to output scan signals having pulses of opposite polarities to drive the display.

Discussion of the Background

An Organic Light Emitting Display (OLED) is a display device having a fast response speed and driven at low power consumption.

The OLED includes a scan driver supplying a scan signal to scan lines to control the supply of a data signal to pixels. To this end, the scan driver includes a plurality of stages coupled to the respective scan lines.

Each of the stages may be configured with a plurality of transistors and a capacitor. However, continuous charging and discharging of the capacitors in the stages may increase power consumption of an OLED driven with low power.

The above information disclosed in this Background section is only for understanding of the background of the inventive concepts, and, therefore, it may contain information that does not constitute prior art.

SUMMARY

Scan drivers constructed according to the principles and exemplary implementations of the invention are capable of supplying scan signals to activate pixels in a display controlled by N-type transistors.

Stages in a scan driver constructed according to the principles and exemplary implementations of the invention are capable of preventing charging and discharging of a capacitor in the stage while an output scan signal is maintaining a low voltage.

Additional features of the inventive concepts will be set forth in the description which follows, and in part will be apparent from the description, or may be learned by practice of the inventive concepts.

According to an aspect of the invention, a stage of a scan driver for a display device, the state includes an output unit to output to an output terminal either a signal supplied to a first clock terminal corresponding to voltages of a first driving node or a voltage of a second power source corresponding to voltage of a second driving node; an input unit to control the voltage of the first driving node, corresponding to signals supplied to a first input terminal, the input unit to control the voltage of the second driving node corresponding to signals supplied to a second input terminal and a second clock terminal; a first signal processor including a second capacitor coupled between the second driving node and a second node, the first signal processor to control the voltage of the second driving node corresponding to signals supplied to a third clock terminal and a fourth clock terminal, the first signal processor to control a potential difference between both ends of the second capacitor corresponding to the signal supplied to the fourth clock terminal; and a second signal processor to control the voltage of the first driving node, corresponding to the signal supplied to the first clock terminal.

The input unit may include: a first transistor coupled between the second input terminal and the second driving node, the first transistor having a gate electrode coupled to the second clock terminal; a second transistor diode-coupled between the first input terminal and the first driving node; and a third transistor coupled between the second input terminal and the first signal processor, the third transistor having a gate electrode coupled to the second clock terminal.

The stage may further include a third signal processor coupled between the input unit and the first driving node to control the voltage of the first driving node.

The third signal processor may include a fourth transistor coupled between the first transistor and the second driving node, the fourth transistor having a gate electrode coupled to a third input terminal being operable to receive a control signal.

The control signal may be supplied as a gate-on voltage of the fourth transistor during a high frequency driving mode, and be supplied as a gate-off voltage of the fourth transistor in at least one frame to perform bias during a low frequency driving mode.

The stage may further include: a first stabilizer coupled between the first signal processor and the second driving node, the first stabilizer controlling a voltage drop of the second driving node; and a second stabilizer coupled between the input unit and the first signal processor, the second stabilizer controlling a voltage drop of a first node in the first signal processor.

The first stabilizer may include a fifth transistor coupled between the first transistor and the second driving node, the fifth transistor having a gate electrode operable to receive voltage from the second power source.

The second stabilizer may include a sixth transistor coupled between the fifth transistor and the first node, the sixth transistor having a gate electrode operable to receive voltage from the second power source.

The input unit may include: a first transistor coupled between the second input terminal and the second driving node, the first transistor having a gate electrode coupled to the second clock terminal; a second transistor diode-coupled between a second node and the first driving node; a third transistor coupled between the second input terminal and the first signal processor, the third transistor having a gate electrode coupled to the second clock terminal; a seventh transistor coupled between a first power source and the second node, the seventh transistor having a gate electrode coupled to the first input terminal; and an eighth transistor coupled between the second node and the second power source, the eighth transistor having a gate electrode coupled to the first input terminal. The seventh transistor may be a p-type transistor, and the eighth transistor may be an n-type transistor.

The first signal processor may further include: a ninth transistor coupled between the first power source and a third node, the ninth transistor having a gate electrode coupled to the fourth clock terminal; a tenth transistor coupled between the third node and the third clock terminal, the tenth transistor having a gate electrode coupled to a first node; and a eleventh transistor diode-coupled between the first node and the second driving node; and a first capacitor coupled between the first node and the third node. The potential difference between the ends of the second capacitor may be controllable according to the signal supplied to the fourth clock terminal.

The potential difference between the ends of the first capacitor may be maintained substantially constant while the voltage of the second power source is being output to the output terminal.

The output terminal may be operable to output a scan signal having a first polarity, the second input terminal may be operable to receive the first polarity scan signal of a previous stage, and the first input terminal may be operable to receive a scan signal of the previous stage having a second polarity. The first polarity and the second polarity may be opposite to each other.

According to another aspect of the invention, a scan driver including a plurality of stages to supply a scan signal to scan lines of a display device, the scan driver includes a first stage array having a plurality of first stages to provide scan signals of a first polarity to scan lines; and a second stage array having a plurality of second stages to provide scan signals of a second polarity to scan lines. At least one of the first stages includes an output unit to output to an output terminal either a signal supplied to a first clock terminal corresponding to voltages of a first driving node or a voltage of a second power source corresponding to voltage of a second driving node; an input unit to control the voltage of the first driving node, corresponding to signals supplied to a first input terminal, and the input unit being to control the voltage of the second driving node corresponding to signals supplied to a second input terminal and a second clock terminal; a first signal processor to control the voltage of the second driving node corresponding to signals supplied to a third clock terminal and a fourth clock terminal; and a second signal processor to control the voltage of the first driving node, corresponding to the signal supplied to the first clock terminal.

The input unit may include: a first transistor coupled between the second input terminal and the second driving node, the first transistor having a gate electrode coupled to the second clock terminal; a second transistor diode-coupled between the first input terminal and the first driving node; and a third transistor coupled between the second input terminal and the first signal processor, the third transistor having a gate electrode coupled to the second clock terminal.

The scan driver may further include a third signal processor coupled between the input unit and the first driving node to control the voltage of the first driving node.

The third signal processor may include a fourth transistor coupled between the first transistor and the second driving node, the fourth transistor having a gate electrode coupled to a third input terminal which is operable to receive a control signal.

The control signal may be supplied as a gate-on voltage of the fourth transistor during high frequency driving mode, and be supplied as a gate-off voltage of the fourth transistor in at least one frame to perform bias during low frequency driving mode.

The scan driver may further include: a first stabilizer coupled between the first signal processor and the second driving node, the first stabilizer being operable to control an amount of a voltage drop of the second driving node; and a second stabilizer coupled between the input unit and the first signal processor, the second stabilizer controlling a voltage drop of a first node in the first signal processor.

The first stabilizer may include a fifth transistor coupled between the first transistor and the second driving node, the fifth transistor having a gate electrode supplied voltage of the second power source, and the second stabilizer may include an sixth transistor coupled between the fifth transistor and the first node, the sixth transistor having a gate electrode operable to receive voltage from the second power source.

The input unit may include: a first transistor coupled between the second input terminal and the second driving node, the first transistor having a gate electrode coupled to the second clock terminal; a second transistor diode-coupled between a second node and the first driving node; a third transistor coupled between the second input terminal and the first signal processor, the third transistor having a gate electrode coupled to the second clock terminal; a seventh transistor coupled between a first power source and the second node, the seventh transistor having a gate electrode coupled to the first input terminal; and an eighth transistor coupled between the second node and the second power source, the eighth transistor having a gate electrode coupled to the first input terminal. The seventh transistor may be a p-type transistor, and the eighth transistor may be an n-type transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
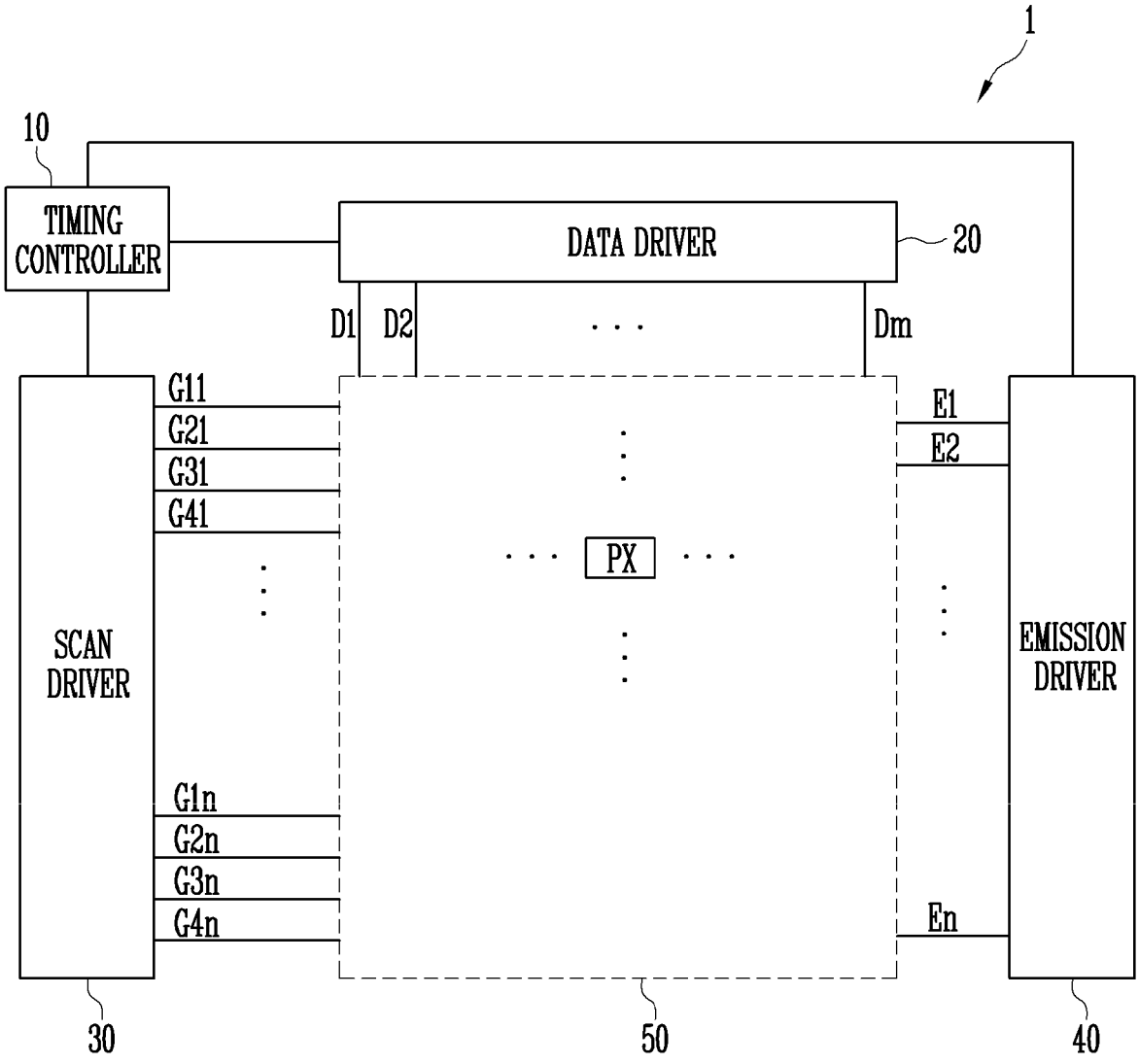
FIG. 1 is a block diagram of to an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of a display device according to an exemplary embodiment of a display device constructed according to the principles of the invention.

Referring to FIG. 1, the display device 1 according to the exemplary embodiment may include a timing controller 10, a data driver 20, a scan driver 30, an emission driver 40, and a display unit 50.

The timing controller 10 may provide grayscale values and control signals to the data driver 20 to be suitable for specifications of the data driver 20. Also, the timing controller 10 may provide a clock signal, a scan start signal, etc. to the scan driver 30 to be suitable for specifications of the scan driver 30. Also, the timing controller 11 may provide a clock signal, an emission stop signal, etc. to the emission driver 40 to be suitable for specifications of the emission driver 40.

The data driver 20 may generate data voltages to be provided to data lines D1 to Dm, using the grayscale values and control signals, which are received from the timing controller 10. For example, the data driver 20 may sample grayscale values, using a clock signal, and apply data voltages corresponding to the grayscale values to the data lines D1 to Dm in units of pixel rows. Here, m may be a natural number.

The scan driver 30 may generate scan signals to be provided to scan lines G11 to G1*n*, G21 to G2*n*, G31 to G3*n*, and G41 to G4*n* by receiving the clock signal, the scan start signal, etc. Here, n may be a natural number.

The scan driver 30 may provide scan signals having pulses of opposite polarities. A polarity may mean a logic level of a pulse, such as a high or low level, or a negative or positive level. In an example, the scan driver 30 may provide a scan signal of a first polarity to first scan lines G11 to Gln and second scan lines G21 to G2*n*, and provide a scan signal of a second polarity opposite to the first polarity to third scan lines G31 to G3*n* and fourth scan lines G41 to G4*n*. To this end, the scan driver 30 may include first stages that provide a first polarity scan signal and second stages that provide a second polarity scan signal.

In an exemplary embodiment, scan signals of the first polarity, which are respectively provided to the first and second scan lines G11 to G1*n* and G21 to G2*n* may have the same wavelength or different wavelengths. Similarly, scan signals of the second polarity, which are respectively provided to the third and fourth scan lines G31 to G3*n* and G41 to G4*n* may have the same wavelength or different wavelengths.

When a pulse is of the first polarity, the pulse may have a gate-on voltage of a high level. When the gate-on voltage of the pulse of the first polarity is supplied to a gate electrode of an N-type transistor, the N-type transistor may be turned on. A case where a voltage of a sufficiently low level is applied to a source electrode of the N-type transistor as compared with the gate electrode of the N-type transistor is assumed. For example, the N-type transistor may be an NMOS transistor.

Also, when a pulse is of the second polarity, the pulse may have a gate-on voltage of a low level. When the gate-on voltage of the pulse of the second polarity is supplied to a gate electrode of the P-type transistor, the P-type transistor may be turned on. A case where a voltage of a sufficiently high level is applied to a source electrode of the P-type transistor as compared with the gate electrode of the P-type transistor is assumed. For example, the P-type transistor may be a PMOS transistor.

The emission driver 40 may generate emission signals to be provided to the emission control lines E1 to En by receiving the clock signal, the emission stop signal, etc. from the timing controller 10. For example, the emission driver 40 may sequentially provide the emission signals having a pulse of a turn-off level to the emission control lines E1 to En. For example, the emission driver 40 may be configured in the form of a shift register, and generate the emission signals in a manner that sequentially transfers the emission stop signal having the pulse of the turn-off level to a next emission stage circuit under the control of the clock signal.

The display unit 50 includes pixels PX. For example, each pixel PX may be coupled to a corresponding data line, corresponding to first to fourth scan lines, and a corresponding emission control line.

Figure 2:
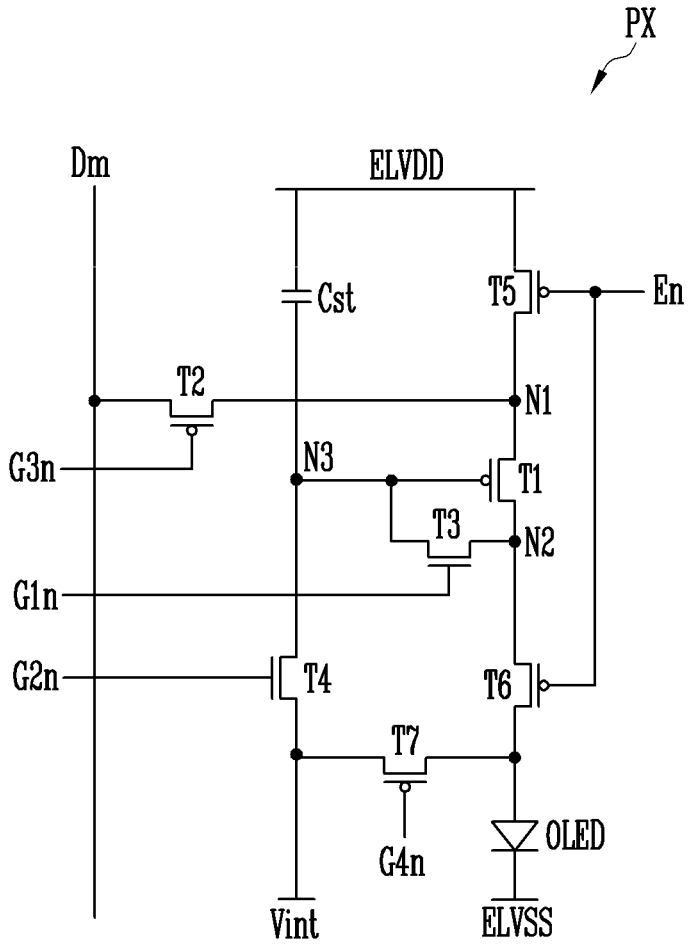
FIG. 2 is a circuit diagram of a representative pixel of the display device of FIG. 1.

FIG. 2 is a circuit diagram of a representative pixel of the display device of FIG. 1.

Referring to FIG. 2, the pixel PX according to the exemplary embodiment includes first to seventh transistors T1 to T7, a storage capacitor Cst, and an organic light emitting diode OLED.

The first transistor T1 is coupled between a first node N1 and a second node N2. A gate electrode of the first transistor T1 is coupled to a third node N3. The first transistor T1 may be referred to as a driving transistor.

The second transistor T2 is coupled between a data line Dm and the first node N1. A gate electrode of the second transistor T2 is coupled to a third scan line G3*n*. The second transistor T2 may be referred to as a switching transistor, a scan transistor, or the like.

The third transistor T3 may be coupled between the third node N3 and the first node N1. A gate electrode of the third transistor T3 is coupled to a first scan line Gln. The third transistor T3 may be referred to as a diode-coupled transistor.

The fourth transistor T4 is coupled between the third node N3 and an initialization power source Vint. A gate electrode of the fourth transistor T4 is coupled to a second scan line G2*n*. The fourth transistor T4 may be referred to as a gate initialization transistor.

One electrode of the fifth transistor T5 is coupled between a first driving power source ELVDD and the first node N1. A gate electrode of the fifth transistor T5 is coupled to an emission control line En. The fifth transistor T5 may be referred to as a first emission transistor.

The sixth transistor T6 is coupled between the second node n2 and an anode of the organic light emitting diode OLED. A gate electrode of the sixth transistor T6 is coupled to the emission control line En. The sixth transistor T6 may be referred to as a second emission transistor.

The seventh transistor T7 is coupled between the organic light emitting diode OLED and the initialization power source Vint. A gate electrode of the seventh transistor T7 is coupled to a fourth scan line G4*n*. The seventh transistor T7 may be referred to as an anode initialization transistor.

The storage capacitor Cst is coupled between the first driving power source ELVDD and the third node N3.

The anode of the organic light emitting diode OLED is coupled to the second node N2, and a cathode of the organic light emitting diode OLED may be coupled to a second driving power source ELVSS. The second driving power source ELVSS may be set lower than the first driving power source ELVDD.

The first, second, fifth, sixth, and seventh transistors T1, T2, T5, T6, and T7 may be implemented as a P-type transistor. A channel of the P-type transistor may be configured with poly-silicon. The poly-silicon transistor may be a Low Temperature Poly-Silicon (LTPS) transistor. The poly-silicon transistor has high electron mobility, and accordingly has a fast driving characteristic.

The third and fourth transistors T3 and T4 may be implemented as an N-type transistor. A channel of the N-type transistor may be configured with an oxide semiconductor. The oxide semiconductor transistor can be formed through a low temperature process, and has a charge mobility lower than that of the poly-silicon transistor. Thus, oxide semiconductor transistors have an amount of leakage current generated in a turn-off state, which is smaller than that of poly-silicon transistors.

In some exemplary embodiments, the seventh transistor T7 may be configured with an N-type oxide semiconductor transistor instead of the poly-silicon transistor. In this case, in substitute for the fourth scan line G4*n*, the first scan line Gln or the second scan lines G2*n* may be coupled to the gate electrode of the seventh transistor T7.

Figure 3:
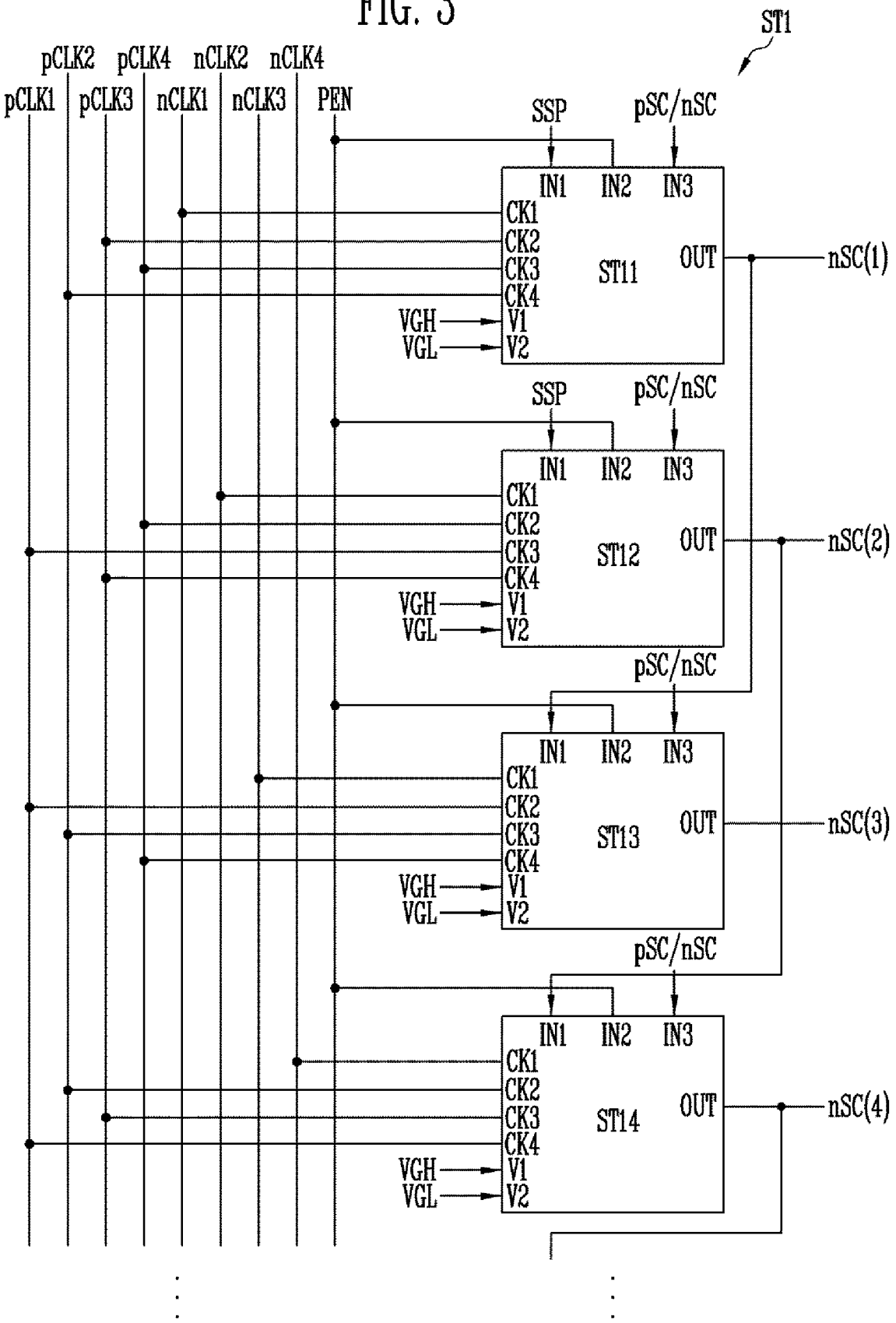
FIG. 3 is a block diagram of an exemplary embodiment of first stage array of a scan driver constructed according to the principles of the invention.

FIG. 3 is a block diagram of an exemplary embodiment of first stage array of a scan driver constructed according to the principles of the invention.

Referring to FIG. 3, the scan driver 30 constructed according to the principles and exemplary embodiment of the invention includes a first stage array ST1 having a plurality of first stages ST11 to ST14 for providing a scan signal of a first polarity to the first scan lines G11 to G1*n* and/or the second scan lines G21 to G2*n*. For convenience of description, four first stages ST11 to ST14 are illustrated in FIG. 3.

The first stages ST11 to ST14 may supply first polarity scan signals nSC(1), nSC(2), nSC(3), and nSC(4) to scan lines G1 (e.g., G11 or G21), G2 (e.g., G12 or G22), G3 (e.g., G13 or G23), and G4 (e.g., G14 or G24) in response to a scan start signal SSP. For example, an nth first stage ST1*n* may output an nth first polarity scan signal nSC(n) to an nth scan line Gn (e.g., Gln or G2*n*).

Each of the first stages ST11 to ST14 as shown in FIG. 3 may include a first input terminal IN1, a second input terminal IN2, a third input terminal IN3, a first clock terminal CK1, a second clock terminal CK2, a third clock terminal CK3, a fourth clock terminal CK4, a first power terminal V1, a second power terminal V2, and an output terminal OUT.

The scan start signal SSP or a first polarity scan signal of a previous first stage may be input to the first input terminal IN1. In an exemplary embodiment, the scan start signal SSP is supplied to the first input terminal IN1 of a first first stage ST11, and a scan signal of a previous first stage may be supplied to each of the first stages except the first first stage ST11 as shown in FIG. 3. In the same manner, a first polarity scan signal nSC(n−2) of an (n−2)th first stage ST1*n*-2 may be supplied to the first input terminal IN1 of the nth first stage ST1*n*. Here, n is a natural number of 3 or more.

A control signal PEN may be input to the second input terminal IN2. The control signal PEN may maintain a gate-on voltage when the display device 1 is driven at a high frequency, maintain the gate-on voltage during at least one frame in one period (shown in FIGS. 6, 8 and 9) including a plurality of frames when the display device 1 is driven at a low frequency, and maintain a gate-off voltage during the other frames.

A second polarity scan signal pSC output from a previous second stage which will be described later is input to the third input terminal IN3. In an exemplary embodiment, a second polarity scan signal pSC(n−1) output from an (n−1) th second stage ST2(*n*−1) may be input to the third input terminal IN3.

In another exemplary embodiment, a first polarity scan signal nSC output from the previous first sage may be input to the third input terminal IN3. In an exemplary embodiment, an (n−1)th first polarity scan signal nSC(n−1) may be input to the third input terminal IN3 of the nth first stage ST1*n*.

Any one n-type clock signal among first to fourth n-type clock signals nCLK1 to nCLK4 may be applied to the first clock terminal CK1. In an exemplary embodiment, when the first n-type clock signal nCLK1 is input to the first clock terminal CK1 of the nth first stage ST1*n*, the second n-type clock signal nCLK2 may be input to the first clock terminal CK1 of an (n+1)th first stage ST1*n*+1, the third n-type clock signal nCLK3 may be input to the first clock terminal CK1 of an (n+2)th first stage ST1*n*+1, and the fourth n-type clock signal nCLK4 may be input to the first clock terminal CK1 of an (n+3)th first stage ST1*n*+3. In an exemplary embodiment, the first n-type clock signal nCLK1 and the third n-type clock signal nCLK3 may be signals having a difference of a half period, and the second n-type clock signal nCLK2 and the fourth n-type clock signal nCLK4 may be signals having a difference of a half period.

In an exemplary embodiment, the gate-on voltage period of each of the n-type clock signals nCLK1 to nCLK4 may correspond to two horizontal periods 2H. In addition, the gate-on voltage period of the first n-type clock signal nCLK1 and the gate-on voltage period of the second n-type clock signal nCLK2 may overlap with each other during one horizontal period 1H. However, this is merely illustrative, and the wavelength relationship between the n-type clock signals nCLK1 to nCLK4 is not limited thereto. In addition, the number of n-type clock signals supplied to one stage is not limited thereto.

Each of the first to fourth n-type clock signals nCLK1 to nCLK4 may be set as a square wave signal in which a logic high level and a logic low level are alternately repeated. The logic high level may correspond to the gate-on voltage, and the logic low level may correspond to the gate-off voltage.

Any one p-type clock signal among first to fourth p-type clock signals pCLK1 to pCLK4 may be applied to the second clock terminal CK2, another p-type clock signal among the first to fourth p-type clock signals pCLK1 to pCLK4 may be applied to the third clock terminal CK3, and still another p-type clock signal among the first to fourth p-type clock signals pCLK1 to pCLK4 may be applied to the fourth clock signal CK4. In an exemplary embodiment, when the first n-type clock signal nCLK1 is applied to the first clock terminal CK1 of a first stage, the third p-type clock signal pCLK3, the fourth p-type clock signal pCLK4, and the second p-type clock signal pCLK2 may be respectively input to the second to fourth clock terminals CK2 to CK4. In an exemplary embodiment, the third p-type clock signal pCLK3 and the fourth p-type clock signal pCLK4 may be signals having a difference of ¼ period, and the fourth p-type clock signal pCLK4 and the second p-type clock signal pCLK2 may be signals having a difference of a half period.

In an exemplary embodiment, when the third p-type clock signal pCLK3 is input to the second clock terminal CK of the nth first stage ST1*n*, the fourth p-type clock signal pCLK4 may be input to the second clock terminal CK2 of the (n+1)th first stage ST1*n*+1, the first p-type clock signal pCLK1 may be input to the second clock terminal CK2 of the (n+2)th first stage ST1*n*+2, and the second p-type clock signal pCLK2 may be input to the second clock terminal CK2 of the (n+3)th first stage ST1*n*+3.

The first power terminal V1 may receive the voltage of a first power source VGH, and the second power terminal V2 may receive the voltage of a second power source VGL.

The output terminal OUT may output the first polarity scan signals nSC(1), nSC(2), nSC(3), and nSC(4). The first polarity scan signal nSC(n) output to the output terminal OUT of the nth first stage ST1*n* may be supplied to the first input terminal IN1 of a next first stage, e.g., the (n+2)th first stage ST1*n*+2.

Figure 4:
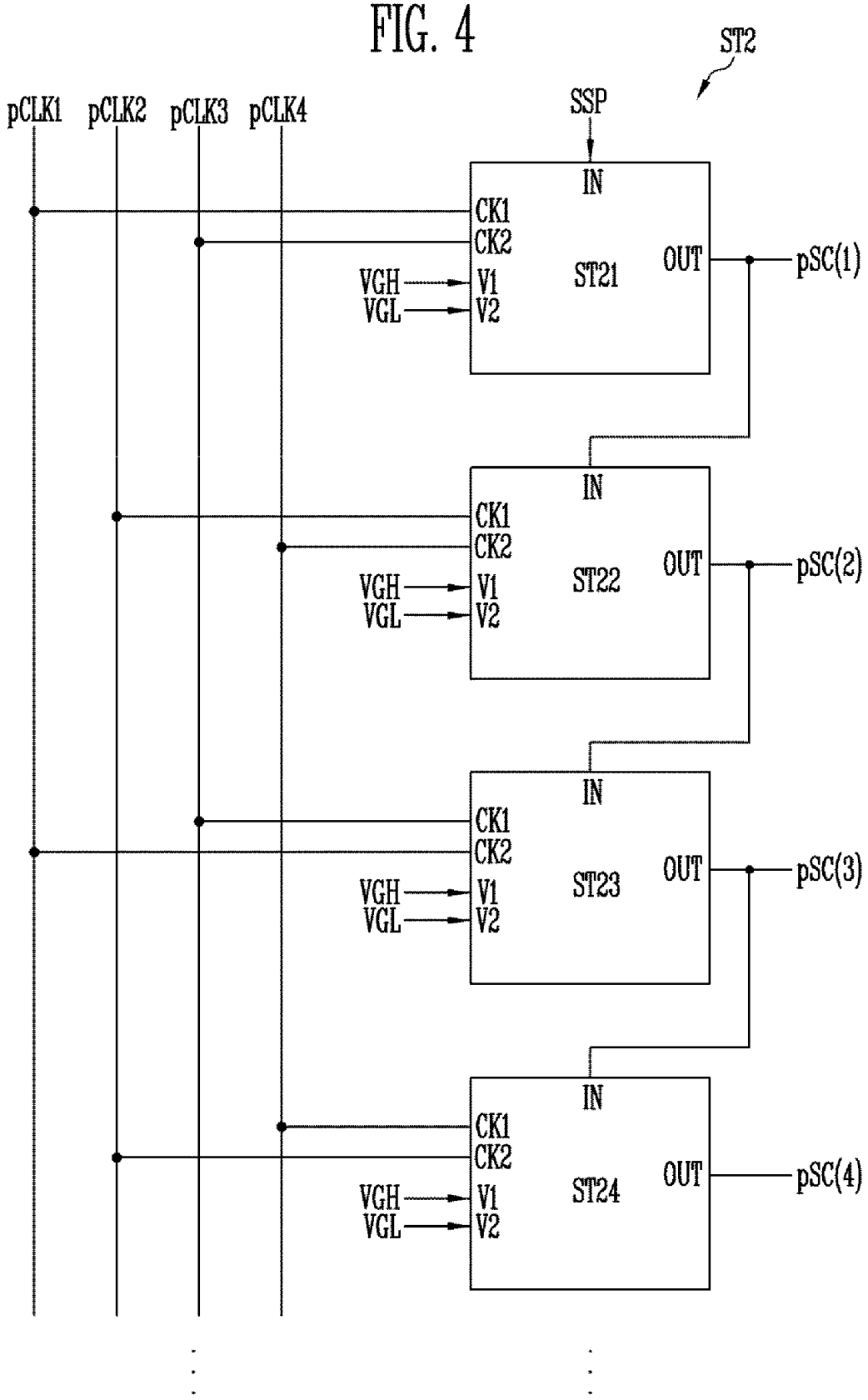
FIG. 4 is a block diagram of an exemplary embodiment of second stage array of a scan driver constructed according to the principles of the invention.

FIG. 4 is a block diagram of an exemplary embodiment of second stage array of a scan driver constructed according to the principles of the invention. In FIG. 4, p-type clock signals pCLK1 to pCLK4 are the same signals as shown in FIG. 3.

Referring to FIGS. 1, 3, and 4, the scan driver 30 constructed according to the principles and exemplary embodiments on the invention includes second stage array ST2 having a plurality of second stages ST21 to ST24 for providing a scan signal of a second polarity to the third scan lines G31 to G3*n* and/or the fourth scan lines G41 to G4*n*. For convenience of description, four second stages ST21 to ST24 are illustrated in FIG. 4.

The second stages ST21 to ST24 may supply second polarity scan signals pSC(1), pSC(2), pSC(3), and pSC(4) to scan lines G1 (e.g., G31 or G41), G2 (e.g., G32 or G42), G3 (e.g., G33 or G43), and G4 (e.g., G34 or G44) in response to a scan start signal SSP. For example, an nth second stage ST2*n* may output an nth second polarity scan signal pSC(n) to an nth scan line Gn (e.g., G3*n* or G4*n*).

Each of the second stages ST21 to ST24 as shown in FIG. 4 may include an input terminal IN, a first clock terminal CK1, a second clock terminal CK2, a first power terminal V1, a second power terminal V2, and an output terminal OUT.

The scan start signal SSP or a second polarity scan signal of a previous second stage may be input to the input terminal IN. In an exemplary embodiment, the scan start signal SSP may be supplied to the input terminal IN of a first second stage ST21, and a scan signal of a previous second stage may be supplied to each of the second stages except the first second stage ST21. In an exemplary embodiment, a second polarity scan signal pSC(n−1) of an (n−1)th second stage ST2*n*-1 may be supplied to the input terminal IN of the nth second stage ST2*n*. Here, n is a natural number of 2 or more.

Any one p-type clock signal among first to fourth p-type clock signals pCLK1 to pCLK4 may be applied to the first clock terminal CK1, and another p-type clock signal among the first to fourth p-type clock signals pCLK1 to pCLK4 may be applied to the second clock terminal CK2. In an exemplary embodiment, when the first p-type clock signal pCLK1 is applied to the nth second stage ST2*n*, the another p-type clock signal may be the third p-type clock signal pCLK3. In addition, when the second p-type clock signal pCLK2 is applied to the nth second stage ST2*n*, the another p-type clock signal may be the fourth p-type clock signal pCLK4.

In an exemplary embodiment, when the first p-type clock signal pCLK1 is input to the first clock terminal CK1 of the nth second stage ST2*n* and the third p-type clock signal pCLK3 is input to the second clock terminal CK2 of the nth second stage ST2*n*, the second p-type clock signal pCLK2 may be input to the first clock terminal CK1 of an (n+1)th second stage ST2*n*+1, and the fourth p-type clock signal pCLK4 may be input to the second clock terminal CK2 of the (n+1)th second stage ST2*n*+1. In addition, the third p-type clock signal pCLK3 may be input to the first clock terminal CK1 of an (n+2)th second stage ST2*n*+2, the first p-type clock signal pCLK1 may be input to the second clock terminal CK2 of the (n+2)th second stage ST2*n*+2, the fourth p-type clock signal pCLK4 may be input to the first clock terminal CK1 of an (n+3)th second stage ST2*n*+3, and the second p-type clock signal pCLK2 may be input to the second clock terminal CK2 of the (n+3)th second stage ST2*n*+3. In an exemplary embodiment, the first p-type clock signal pCLK1 and the third p-type clock signal pCLK3 may be signals having a difference of a half period, and the second p-type clock signal pCLK2 and the fourth p-type clock signal pCLK4 may be signals having a difference of a half period.

In an exemplary embodiment, the gate-on voltage period of each of the p-type clock signals pCLK1 to pCLK4 may correspond to two horizontal periods 2H. In addition, the gate-on voltage period of the first p-type clock signal pCLK1 and the gate-on voltage period of the second p-type clock signal pCLK2 may overlap with each other during one horizontal period 1H. However, this is merely illustrative, and the wavelength relationship between the p-type clock signals pCLK1 to pCLK4 is not limited thereto. In addition, the number of p-type clock signals supplied to one stage is not limited thereto.

Each of the first to fourth p-type clock signals pCLK1 to pCLK4 may be set as a square wave signal in which a logic high level and a logic low level are alternately repeated. The logic high level may correspond to the gate-off voltage, and the logic low level may correspond to the gate-on voltage.

The first power terminal V1 may receive the voltage of a first power source VGH, and the second power terminal V2 may receive the voltage of a second power source VGL.

The output terminal OUT may output the second polarity scan signals pSC(1), pSC(2), pSC(3), and pSC(4). The second polarity scan signal pSC(n) output to the output terminal OUT of the nth second stage ST2*n* may be supplied to the input terminal IN of a next second stage, e.g., the (n+1)th second stage ST2*n*+1. In addition, the second polarity scan signal pSC(n) output to the output terminal OUT of the nth second stage ST2*n* may be supplied to the third input terminal IN3 of a nest first stage, e.g., the (n+1)th first stage ST1*n*+1. For example, the first second polarity scan signal pSC(1) of the first second stage S21 may be supplied to the third input terminal IN3 of the second first stage S12 as shown in FIG. 3.

Figure 5:
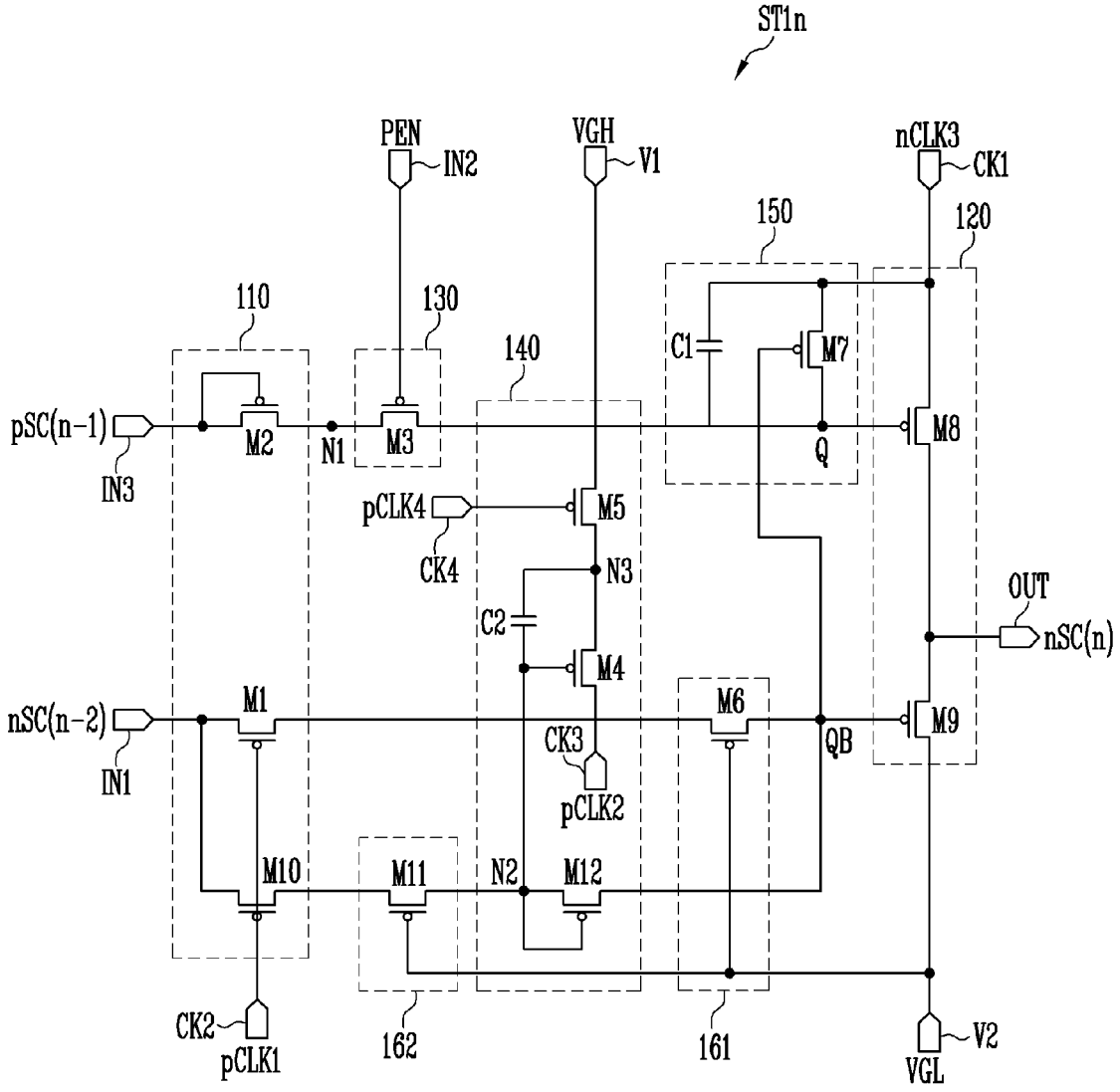
FIG. 5 is a circuit diagram of a first exemplary embodiment of the first stage shown in FIG. 3.

FIG. 5 is a circuit diagram of a first exemplary embodiment of the first stage shown in FIG. 3.

For convenience of description, only an nth first stage ST1*n* is illustrated in FIG. 5, but all the first stages shown in FIG. 3 such as ST11, ST12, ST13 and ST 14 may have the same or substantially the same structure as the nth first stage ST1*n* described below.

Referring to FIGS. 1, 3, and 5, the nth first stage ST1*n* according to the first exemplary embodiment includes an input unit 110, an output unit 120, a first signal processor 130, a second signal processor 140, a third signal processor 150, and first and second stabilizers 161 and 162.

The output unit 120 outputs the voltage of the first power source VGH or the second power source VGL to the output terminal OUT in response to voltages of a first driving node Q and a second driving node QB. To this end, the output unit 120 includes an eighth transistor M8 and a ninth transistor M9.

The eighth transistor M8 is coupled between the first clock terminal CK1 to which the third n-type clock signal nCLK3 is applied and the output terminal OUT. In addition, a gate electrode of the eighth transistor M8 is coupled to the first driving node Q. The eighth transistor M8 is turned on or turned off corresponding to the voltage of the first driving node Q. The third n-type clock signal nCLK3 supplied to the output terminal OUT when the eighth transistor M8 is turned on is output as a first electrode scan signal nSC(n) of an nth scan line Gn (e.g., an nth first scan line Gln and/or an nth second scan line G2*n*).

The ninth transistor M9 is coupled between the output terminal OUT and the second power source VGL. In addition, a gate electrode of the ninth transistor M9 is coupled to the second driving node QB. The ninth transistor M9 is turned on or turned off corresponding to the voltage of the second driving node QB.

The input unit 110 controls voltages of a first node N1, a second node N2, and the second driving node QB in response to signals supplied to the first input terminal IN, the third input terminal IN3, and the second clock terminal CK2. To this end, the input unit 110 includes a first transistor M1, a second transistor M2, and a tenth transistor M10.

A first electrode of the first transistor M1 is coupled to the first input terminal IN1 to which the scan start signal SSP or the first polarity scan signal nSC(n−2) of the (n−2)th first stage ST1*n*-2 is applied, and a second electrode of the first transistor M1 is coupled to the second driving node QB via a sixth transistor M6. A gate electrode of the first transistor M1 is coupled to the second clock terminal CK2. The first transistor M1 is turned on when the first p-type clock signal pCLK1 is supplied to the second clock terminal CK2, to electrically couple the first input terminal IN1 to the second driving node QB.

The second transistor M2 is diode-coupled between the third input terminal IN3 to which the second polarity scan signal pSC(n−1) of the (n−1)th second stage ST2*n*-1 is applied and the first node N1. The second transistor M2 may transfer, to the first node N1, the second polarity scan signal pSC(n−1) of the (n−1)th second stage ST2*n*−1, which is supplied to the third input terminal IN3.

A first electrode of the tenth transistor M10 is coupled to the first input terminal IN1, and a second electrode of the tenth transistor M10 is coupled to the second node N2 via an eleventh transistor M11. A gate electrode of the tenth transistor M10 is coupled to the second clock terminal CK2. The tenth transistor M10 is turned on when the first p-type clock signal pCLK1 is supplied to the second clock terminal CK2, to electrically couple the first input terminal IN1 to the second node N2.

The first signal processor 130 controls the voltage of the first driving node Q in response to the voltage of the first node N1. To this end, the first signal processor 130 includes a third transistor M3.

The third transistor M3 is coupled between the first node N1 and the first driving node Q. A gate electrode of the third transistor M3 is coupled to the second input terminal IN2 to which the control signal PEN is applied. The third transistor M3 is turned on when the control signal PEN is applied, to couple the first node N1 to the first driving node Q. Thus, the third transistor M3 can control the voltage of the first driving node Q.

The second signal processor 140 is coupled to the second driving node QB, and controls the voltage of the second driving node QB in response to signals supplied to the third clock terminal CK3 and the fourth clock terminal CK4. To this end, the second signal processor 140 includes a fourth transistor M4, a fifth transistor M5, a twelfth transistor M12, and a second capacitor C2.

The fifth transistor M5 and the fourth transistor M4 are coupled in series between the first power terminal V1 to which the first power source VGH is applied and the third clock terminal CK3 to which the second p-type clock signal pCLK2 is applied. A common node of the fifth transistor M5 and the fourth transistor M4 is referred to as a third node N3.

A gate electrode of the fifth transistor M5 is coupled to a fourth clock terminal CK4 to which the fourth p-type clock signal pCLK4 is applied. The fifth transistor M5 is turned on or turned off corresponding to the signal supplied to the fourth clock terminal CK4.

A gate electrode of the fourth transistor M4 is coupled to the second node N2. The fourth transistor M4 is turned on or turned off corresponding to the voltage of the second node N2.

The twelfth transistor M12 is coupled between the second node N2 and the second driving node QB. The twelfth transistor M12 may electrically couple the second node N2 to the second driving node QB in response to the voltage of the second node N2.

The second capacitor C2 is coupled between the third node N3 and the second node N2. The second capacitor C2 charges a voltage corresponding to the gate-on voltage of the fourth transistor M4.

The third signal processor 150 controls the voltage of the first driving node Q. To this end, the third signal processor 150 includes a seventh transistor M7 and a first capacitor C1.

The seventh transistor M7 is coupled between the first clock terminal CK1 to which the third n-type clock signal nCLK3 is applied and the first driving node Q. A gate electrode of the seventh transistor M7 is coupled to the second driving node QB. The seventh transistor M7 is turned on or turned off corresponding to the voltage of the second driving node QB. When the seventh transistor M7 is turned on, the first clock terminal CK1 and the first driving node Q may be electrically coupled to each other.

The first capacitor C1 is coupled to the first clock terminal CK1 and the first driving node Q. The first capacitor C1 charges the voltage applied to the first driving node Q. Also, the first capacitor C1 stably maintains the voltage of the first driving node Q.

The first stabilizer 161 is coupled between the second signal processor 140 and the output unit 120. The first stabilizer 161 restricts the degree of voltage drop of the second driving node QB. To this end, the first stabilizer 161 includes the sixth transistor M6.

The sixth transistor M6 is coupled between the first transistor M1 and the second driving node QB. A gate electrode of the sixth transistor M6 is coupled to the second power terminal V2 to which the second power source VGL is applied. The sixth transistor M6 is set to a turn-on state.

The second stabilizer 162 is coupled between the input unit 110 and the second signal processor 140. The second stabilizer 162 restricts the degree of voltage drop of the second node N2. To this end, the second stabilizer 162 includes the eleventh transistor M11.

The eleventh transistor M11 is coupled to the tenth transistor M10 and the second node N2. A gate electrode of the eleventh transistor M11 is coupled to the second power terminal V2. The eleventh transistor M11 is set to the turn-on state.

The transistors M1 to M12 of the first stage ST1 may be implemented with a p-type transistor.

Figure 6:
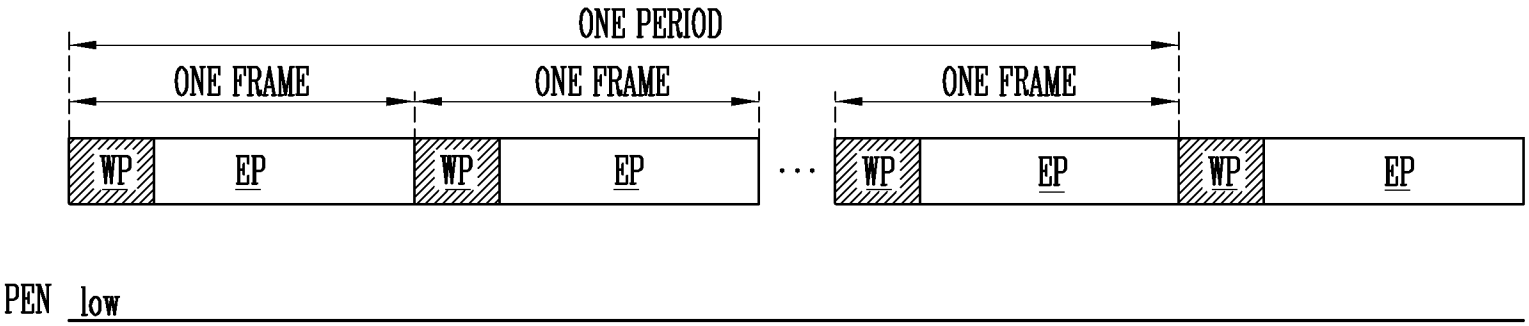
FIG. 6 is a diagram illustrating an exemplary, high frequency operation of the first stage shown in FIG. 5.

FIG. 6 is a diagram illustrating an exemplary, high frequency operation of the first stage shown in FIG. 5.

When the display device 1 is driven using a high frequency driving method, this may be expressed as that the display device 1 is in a first driving mode. Also, when the display device 1 is driven using a low frequency driving method, this may be expressed as that the display device 1 is in a second driving mode.

The first driving mode may be a normal driving mode. That is, when a user uses the display device 1, frames may be displayed at 20 Hz or more, e.g., 60 Hz.

The second driving mode may be a low power driving mode. For example, when the user does not use the display device 1, frames may be displayed at less than 20 Hz, e.g., 1 Hz. For example, a case where only time and date are displayed in an "always on mode" during a common use mode may correspond to the second driving mode.

In the first driving mode, one period may include a plurality of frames. The one period is an arbitrarily defined period, and is a period defined to be compared with the second driving mode. The one period may mean the same time interval in the first and second driving modes.

In the first driving mode, each frame may include a data write period WP and an emission period EP.

In the first driving mode, the control signal PEN may maintain the gate-on voltage which turns on the third transistor M3 during the one period including the plurality of frames. Referring to FIG. 5, the third transistor M3 that receives the control signal PEN through the gate electrode thereof may maintain the turn-on state during the one period.

Figure 7:
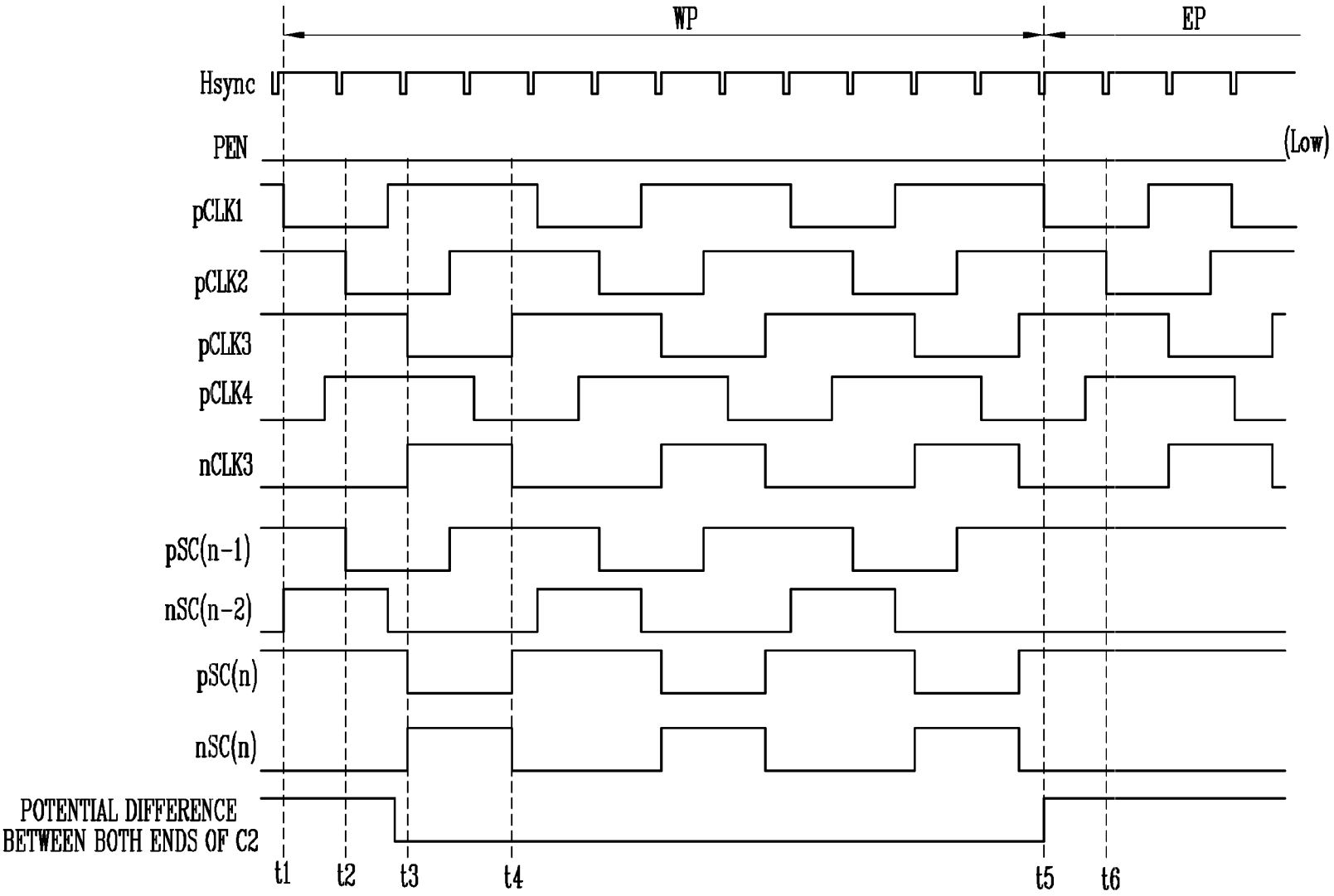
FIG. 7 is an exemplary timing diagram illustrating the high frequency operation of the first stage shown in FIG. 5.

FIG. 7 is an exemplary timing diagram illustrating the high frequency operation of the first stage shown in FIG. 5. For convenience of description an operation in an arbitrary one frame during one period will be described in FIG. 7.

Referring to FIGS. 3, 5 and 7, a timing diagram of clock signals pCLK1, pCLK2, pCLK3, pCLK4, and nCLK3 and scan signals pSC(n−1), nSC(n−2), and nSC(n) is illustrated. A horizontal synchronization signal Hsync is illustrated as a reference signal with respect to timing. An interval between pulses of the horizontal synchronization signal Hsync may be referred to as one horizontal period.

The first to fourth p-type clock signals pCLK1 to pCLK4 are configured with the same square wave, and each of the first to fourth p-type clock signals pCLK1 to pCLK4 may be a signal of which phase is delayed by ¼ period. The third n-type clock signal nCLK3 may be a signal having pulses of which polarity is opposite to that of pulses of the third p-type clock signal pCLK3. Each of the clock signals pCLK1, pCLK2, pCLK3, pCLK4, and nCLK3 may have a high level section set longer than a low level section in one period (e.g., 4H) configured with one square wave. Accordingly, the high level sections of the first to fourth p-type clock signals pCLK1 to pCLK4 may overlap with each other at least once during one period.

During high frequency driving, the control signal PEN maintains the gate-on voltage. Therefore, the third transistor M3 maintains the turn-on state during the high frequency driving.

At a first time t1, the first p-type clock signal pCLK1 of the low level and the previous first polarity scan signal nSC(n−2) of the high level are supplied.

The first and tenth transistors M1 and M10 are turned on by the first p-type clock signal pCLK1 of the low level, and the previous first polarity scan signal nSC(n−2) of the high level is supplied to the second driving node QB. Therefore, the fourth, seventh, and ninth transistors M4, M7, and M9 of which the gate electrodes are coupled to the second driving node QB are turned off.

Since the second transistor M2 is in a state in which it is diode-coupled, the direction of current is toward the other electrode of the second transistor M2, which is a drain electrode, from one electrode of the second transistor M2, which is a source electrode. Therefore, at the first time t1, the second polarity scan signal pSC(n−1) of the high level is not transferred to the first driving node Q. Thus, the first driving node Q maintains a voltage of a previous period.

At a second time t2, the previous second polarity scan signal pSC(n−1) of the low level and the second p-type clock signal pCLK2 of the low level are supplied.

Therefore, the voltage of the first driving node Q becomes the low level according the previous second polarity scan signal pSC(n−1) of the low level, and the eighth transistor M8 of which the gate electrode is coupled to the first driving node Q is turned on. Accordingly, the third n-type clock signal nCLK3 is output to the output terminal OUT, to be used as the first polarity scan signal nSC(n) of the low level.

The voltage of the second driving node QB maintains the high level due to the previous first polarity scan signal nSC(n−2) of the high level and the first p-type clock signal pCLK1 of the low level, and accordingly, the ninth transistor M9 maintains the turn-off state.

At a third time t3, the third n-type clock signal nCLK3 of the high level is supplied.

The eighth transistor M8 maintains the turn-on state, and the ninth transistor M9 maintains the turn-off state. Therefore, the third n-type clock signal nCLK3 of the high level is output as the first polarity scan signal nSC(n) of the high level.

According to an exemplary embodiment, a gate-on voltage of the previous second polarity scan signal pSC(n−1) may overlap with that of the third n-type clock signal nCLK3 during a partial time. The time at which the gate-on voltage of the previous second polarity scan signal pSC(n−1) is generated may precede that at which the gate-on voltage of the third n-type clock signal nCLK3 is generated. That is, referring to FIG. 7, it can be seen that a first falling pulse of the second polarity scan signal pSC(n−1) is generated at the second time t2, and a rising pulse of the third n-type clock signal nCLK3 is generated at the third time t3. That is, if the previous second polarity scan signal pSC(n−1) of the low level is not in a state in which it is supplied to the first driving node Q when the third n-type clock signal nCLK3 is increased to the high level at the third time t3, the voltage of the first driving node Q may be increased due to coupling of the first capacitor C1. Therefore, the eighth transistor M8 may be turned off. Thus, according to the exemplary embodiment, the voltage of the first driving node Q is prevented from being completely increased to the gate-on voltage at the third time t3, so that the turn-on state of the eighth transistor M8 can be ensured.

At a fourth time t4, the third n-type clock signal nCLK3 of the low level is supplied.

The eighth transistor M8 maintains the turn-on state, and the seventh transistor M7 maintains the turn-off state. Therefore, the third n-type clock signal nCLK3 of the low level is output to the output terminal OUT, to be used as the first polarity scan signal nSC(n) of the low level.

At the fourth time t4, the voltage of the first driving node Q becomes lower than the low level due to the coupling of the first capacitor C1. Thus, the eighth transistor M8 stably maintains the turn-on state, and driving characteristics can be improved.

Although a voltage lower than the low level is applied to one electrode of the third transistor M3, the voltage of the other electrode of the third transistor M3 does not become lower than the low level. The one electrode of the third transistor M3 may be connected to the first driving node Q and the other electrode of the third transistor M3 may be connected to the first node N1. When a voltage lower than the low level is applied to the one electrode of the third transistor M3 due to the coupling of the first capacitor C1, the one electrode of the third transistor M3 serves as a drain electrode. Therefore, the other electrode of the third transistor M3 serves as a source electrode. In addition, since the control signal PEN of the low level is applied to the gate electrode of the third transistor M3, a voltage higher than the low level is to be applied to the source electrode of the third transistor M3 such that the third transistor M3 is turned on. Therefore, the third transistor M3 is turned off at the same time the voltage of the source electrode of the third transistor M3 becomes lower than the low level.

Thus, according to the exemplary embodiment, since the voltage of the other electrode of the third transistor M3 is maintained in spite of the coupling of the first capacitor C1, a transient bias voltage is prevented from being applied to the second transistor M2, so that the lifespan of the second transistor M2 can be increased.

At a fifth time, the first and tenth transistor M1 and M10 are turned on by the first p-type clock signal pCLK1 of the low level, and the previous first polarity scan signal nSC (n−2) of the low level is supplied to the second driving node QB. Therefore, the fourth, seventh, and ninth transistors M4, M7, and M9 of which the gate electrodes are coupled to the second driving node QB are turned on.

When the ninth transistor M9 is turned on, a low level voltage of the second power source VGL is output to the output terminal OUT, to be used as the first polarity scan signal nSC(n) of the low level.

When the seventh transistor M7 is turned on, the eighth transistor M8 is in a state in which it is diode-coupled. Therefore, the third n-type clock signal nCLK3 is not supplied to the output terminal OUT. In addition, when the fourth transistor M4 is turned on, a high level voltage of the second p-type clock signal pCLK2 is transferred to the third node N3. In addition, the low level of the previous first polarity scan signal nSC(n−2) is supplied to the second driving node QB, and therefore, the potential difference between both ends of the second capacitor C2 is set to the high level.

At a sixth time t6, the second p-type clock signal pCLK2 of the low level is supplied.

Since the fourth transistor M4 is in the turn-on state, a low level voltage of the second p-type clock signal pCLK2 is supplied to one end of the second capacitor C2. The one end of the second capacitor C2 may be connected to the third node N3 and the other end of the second capacitor C2 may be connected to the second node N2. The voltage of the second node N2 is decreased to a voltage lower than the low level due to coupling of the second capacitor C2. Thus, the potential difference between both the ends of the second capacitor C2 can maintain the high level. Since the twelfth transistor M12 is diode-coupled by the voltage of the second node N2, a change in voltage of the second node N2 has no influence on the second driving node QB.

As described above, in the exemplary embodiments, the previous first polarity scan signal nSC(n−2) is supplied with the low level, and the previous second polarity scan signal pSC(n−1) is supplied with the high level, so that the potential difference between both the ends of the second capacitor C2 is stably maintained while the first polarity scan signal nSC(n) is not being output. Accordingly, charge/discharge does not occur in the second capacitor C2, and consequently, the power consumption of the display device can be reduced.

Figure 8:
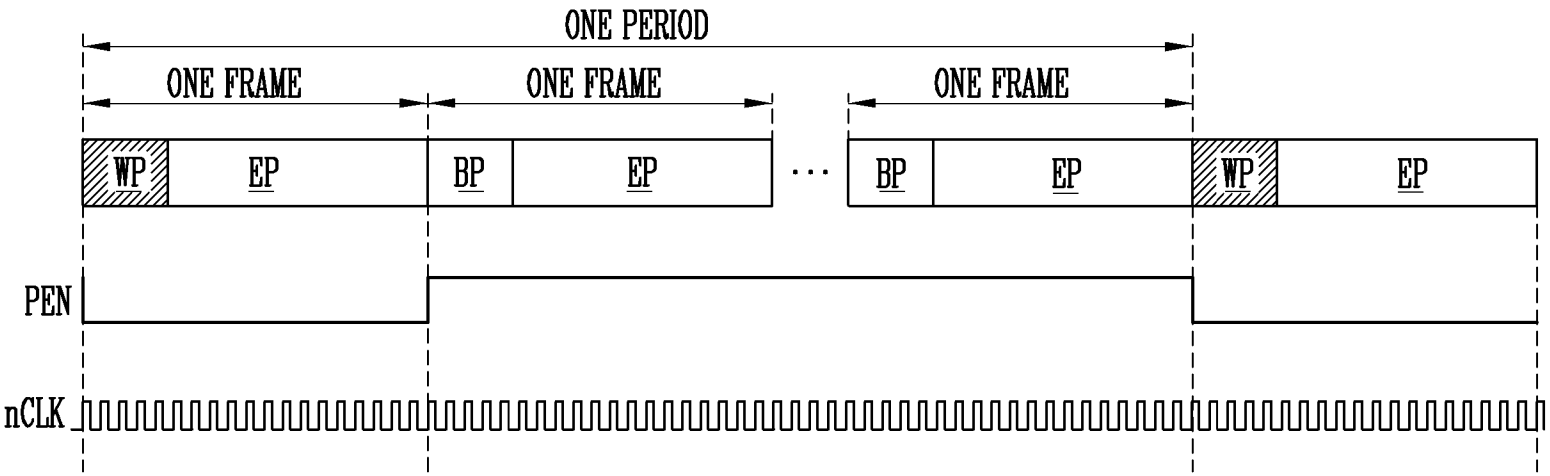
FIG. 8 is a diagram illustrating an exemplary, low frequency operation of the first stage shown in FIG. 5.

FIG. 8 is a diagram illustrating an exemplary, low frequency operation of the first stage shown in FIG. 5.

Referring to FIGS. 2, 5, and 8, in the second driving mode, a first frame in one period includes a data write period WP and an emission period EP, and each of the other frames in the one period include a bias period BP and an emission period EP. The control signal PEN may maintain the gate-on voltage (low level) during one frame in the one period, and maintain the gate-off voltage (high level) during the other frames in the one period.

In the first frame in which the control signal PEN maintains the gate-on voltage, the first stage ST1 may operate identically to the operation shown in FIG. 7. Therefore, a driving method in the other frames will be described below.

When the control signal PEN having the gate-off voltage is supplied, the third transistor M3 of the first stage ST1 maintains the turn-off state, and the first driving node Q continuously maintains the high level voltage. Accordingly, the eighth transistor M8 maintains the turn-off state, and thus the scan driver 30 does not output activated first polarity scan signals nSC in the other frames during the one period.

Accordingly, the third and fourth transistors T3 and T4 of the pixel PX maintain the turn-off state in the other frames during the one period, and thus the storage capacitor Cst maintains the same data voltage during a plurality of frames. In particular, the third and fourth transistors T3 and T4 may be configured with oxide semiconductor transistors, and thus leakage current can be minimized.

Consequently, the pixel PX, which is illustrated in FIG. 2, can display the same image during the one period, based on a data voltage supplied during the data write period WP of the first frame in the one period.

Figure 9:
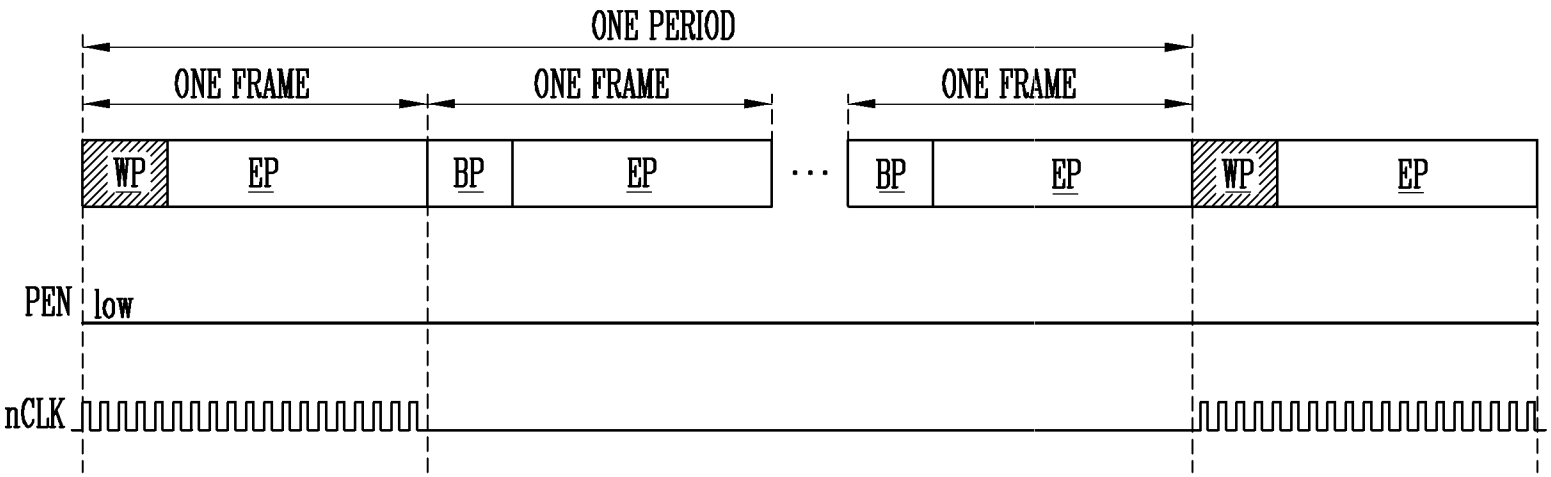
FIG. 9 is a diagram illustrating another exemplary embodiment of the low frequency operation of the first stage shown in FIG. 5.

FIG. 9 is a diagram illustrating another exemplary embodiment of the low frequency operation of the first stage shown in FIG. 5.

Referring to FIGS. 2, 5, and 9, the control signal PEN maintains the turn-on level during one period. An n-type clock signal nCLK outputs pulses during the first frame in the one period, and does not output the pulses in the other frames during the one period.

Accordingly, the third transistor M3 of the first stage ST1 maintains the turn-on state, and only the gate-off voltage is supplied to the eighth transistor M8 of the first stage ST1. Thus, the scan driver 30 does not output activated scan signals nSC of the first polarity in the other frames.

Accordingly, the third and fourth transistors T3 and T4 of the pixel PX maintain the turn-off state in the other frames during the one period. Consequently, the pixel PX can display the same image during the one period, based on a data voltage supplied during the data write period WP of the first frame in the one period.

Figure 10:
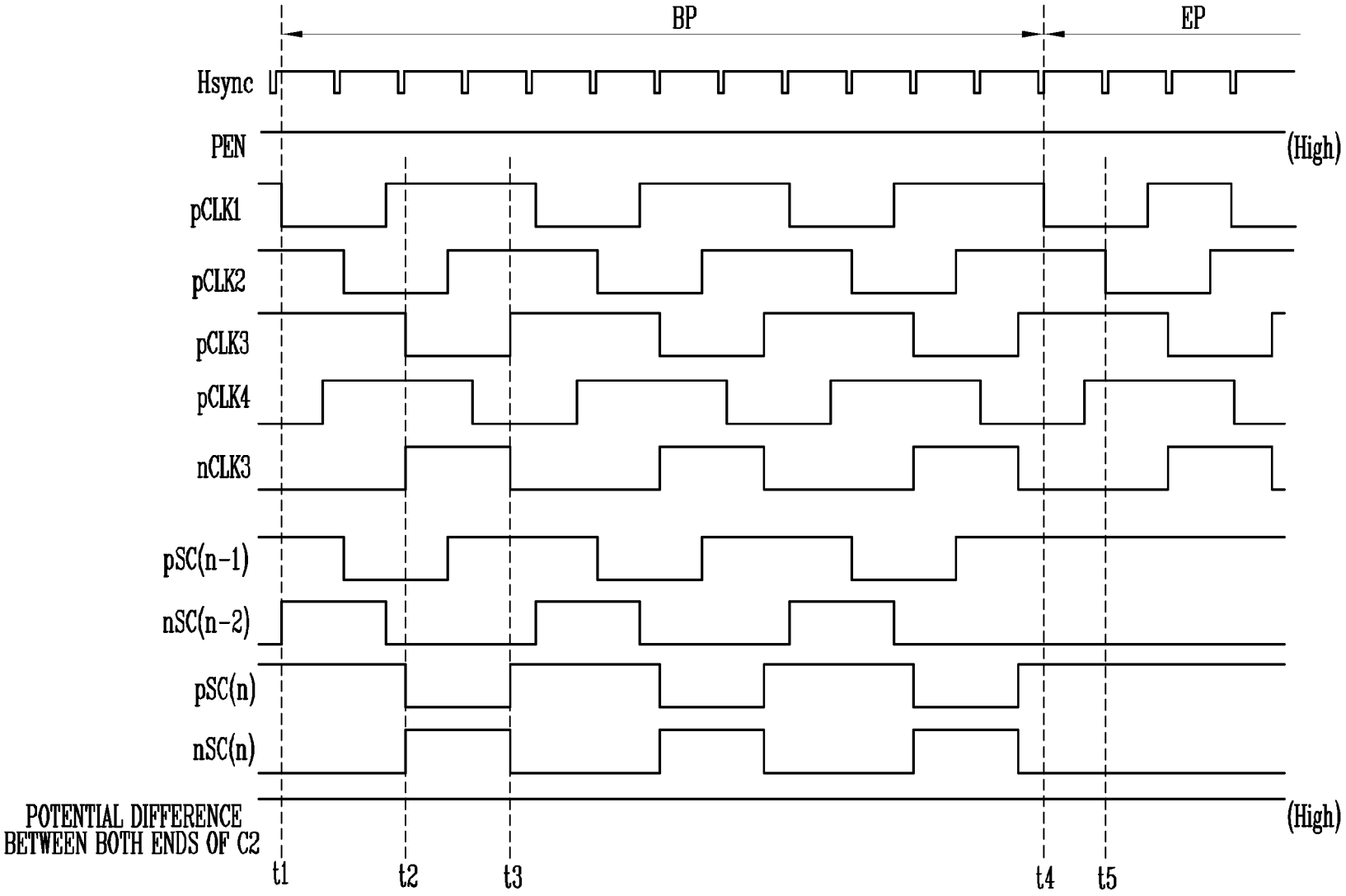
FIG. 10 is an exemplary timing diagram illustrating the low frequency operation of the first stage shown in FIG. 5.

FIG. 10 is an exemplary timing diagram illustrating the low frequency operation of the first stage shown in FIG. 5. In FIG. 10, an operation of the first stage ST1 in a frame including a bias period BP and an emission period EP after the first frame is illustrated in FIG. 10.

Referring to FIG. 10, an exemplary timing diagram of clock signals pCLK1, pCLK2, pCLK3, pCLK4, and nCLK3 and scan signals pSC(n−1), nSC(n−2), and nSC(n) is illustrated. A horizontal synchronization signal Hsync is illustrated as a reference signal with respect to timing. An interval between pulses of the horizontal synchronization signal Hsync may be referred to as one horizontal period.

The first to fourth p-type clock signals pCLK1 to pCLK4 are configured with the same square wave, and each of the first to fourth p-type clock signals pCLK1 to pCLK4 may be a signal of which phase is delayed by ¼ period. The third n-type clock signal nCLK3 may be a signal having pulses of which polarity is opposite to that of pulses of the third p-type clock signal pCLK3. Each of the clock signals pCLK1, pCLK2, pCLK3, pCLK4, and nCLK3 may have a high level section set longer than a low level section in one period (e.g., 4H) configured with one square wave. Accordingly, the high level sections of the first to fourth p-type clock signals pCLK1 to pCLK4 may overlap with each other at least once during one period.

During low frequency driving, the control signal PEN maintains the gate-off voltage. Therefore, the third transistor M3 maintains the turn-off state during the low-frequency driving, and the previous second polarity scan signal pSC (n−1) has no influence on the operation of the first stage ST1. Hence, the wavelength of the previous second polarity scan signal pSC(n−1) is not illustrated in FIG. 10.

At a first time t1, the previous first polarity scan signal nSC(n−2) of the high level is supplied.

The first and tenth transistors M1 and M10 are turned on by the first p-type clock signal pC1K1, and the previous first polarity scan signal nSC(n−2) of the high level is supplied to the second driving node QB. Therefore, the fourth, seventh, ninth transistors M4, M7, and M9 of which the gate electrodes are coupled to the second driving node QB are turned off.

Since the third transistor M3 is in the turn-off state, the first driving node Q maintains a voltage of the previous period, e.g., a voltage of the low level. In particular, the voltage of the first driving node Q is set as a voltage lower than the low level due to coupling of the first capacitor C1. When the voltage of the first driving node Q is set to the low level, the eighth transistor M8 is turned on, so that a low voltage of the third n-type clock signal nCLK3 can be output to the first polarity scan signal nSC(n).

At the first time t1, the fifth transistor M5 is turned on by the first p-type clock signal pCLK, and a high level voltage of the first power source VGH is supplied to the third node N3. Since the tenth and eleventh transistors M10 and M11 are in the turn-on state, the previous first polarity signal nSC(n−1) is supplied to the second node N2, so that the second node N2 is set to the high level voltage. Accordingly, the potential difference between both the ends of the second capacitor C2 maintains the high level.

At a second time t2, the third n-type clock signal nCLK3 of the high level is supplied.

The eighth transistor M8 maintains the turn-on state, and the ninth transistor M9 maintains the turn-off state. Hence, the first polarity scan signal nSC(n) still maintain the low level according to the third n-type clock signal nCLK3.

At the second time t2, the potential difference between both the ends of the second capacitor C2 maintains the high level.

At a third time t3, the third p-type clock signal pCLK3 of the low level is supplied.

The eighth transistor M8 maintains the turn-on state, and the ninth transistor M9 maintains the turn-off state. Hence, the third n-type clock signal nCLK3 of the low level is output to the output terminal OUT, to be used as the first polarity scan signal nSC(n) of the low level.

At the third time t3, the voltage of the first driving node Q becomes lower than the low level due to the coupling of the first capacitor C1. Thus, the eighth transistor M8 stably maintains the turn-on state, and driving characteristics can be improved.

At the third time t3, the potential difference between both the ends of the second capacitor C2 maintains the high level.

At a fourth time t4, the first to tenth transistors M1 and M10 are turned by the first p-type clock signal pCLK1 of the low level, and the previous first polarity scan signal nSC (n−2) of the low level is supplied to the second driving node QB. Therefore, the fourth, seventh, and ninth transistors M4, M7, and M9 of which the gate electrodes are coupled to the second driving node QB are turned on.

When the ninth transistor M9 is turned on, a low level voltage of the second power source VGL is output to the output terminal OUT, so that the first polarity scan signal nSC(n) maintains the low level.

When the seventh transistor M7 is turned on, the eighth transistor M8 is in a state in which it is diode-coupled. Therefore, the third n-type clock signal nCLK3 is not supplied to the output terminal OUT. In addition, when the fourth transistor M4 is turned on, a high level voltage of the second p-type clock signal pCLK2 is transferred to the third node N3. In addition, the low level of the previous first polarity scan signal nSC(n−2) is supplied to the second driving node QB, and therefore, the potential difference between both ends of the second capacitor C2 maintains the high level.

At a fifth time t5, the second p-type clock signal pCLK2 of the low level is supplied.

Since the fourth transistor M4 is in the turn-on state, a low level voltage of the second p-type clock signal pCLK2 is supplied to one end of the second capacitor C2. The voltage of the second node N2 is decreased to a voltage lower than the low level due to coupling of the second capacitor C2. Thus, the potential difference between both the ends of the second capacitor C2 can maintain the high level. Since the twelfth transistor M12 is diode-coupled by the voltage of the second node N2, a change in voltage of the second node N2 has no influence on the second driving node QB.

As described above, in the exemplary embodiments of the invention, the potential difference between both the ends of the second capacitor C2 is stably maintained while the first polarity scan signal nSC(n) is not being output. Accordingly, charge/discharge does not occur in the second capacitor C2, and consequently, the power consumption of the display device can be reduced.

Figure 11:
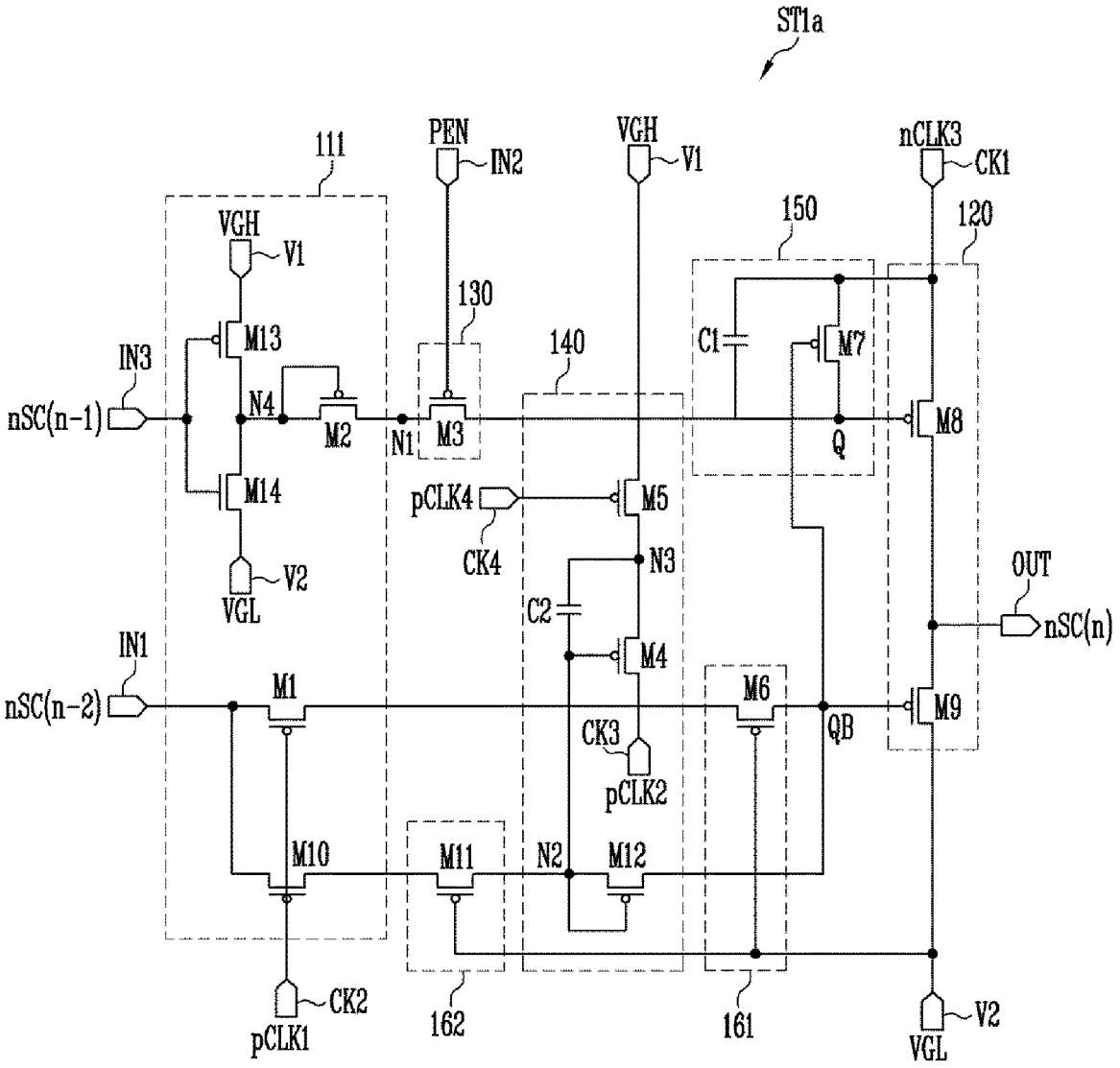
FIG. 11 is a circuit diagram of a second exemplary embodiment of the first stage shown in FIG. 3.

FIG. 11 is a circuit diagram of a second exemplary embodiment of the first stage shown in FIG. 3. In FIG. 11, components identical to those shown in FIG. 5 are designated by like reference numerals, and their detailed descriptions will be omitted to avoid redundancy.

Referring to FIGS. 3, 5, and 11, the first stage ST1*a* according to the second exemplary embodiment includes an input unit 111, an output unit 120, a first signal processor 130, a second signal processor 140, a third signal processor 150, and first and second stabilizers 161 and 162.

The input unit 111 controls voltages of a first node N1, a second node N2, and a second driving node QB, corresponding to signals supplied to the first input terminal IN1, the third input terminal IN3, and the second clock terminal CK2. To this end, the input unit 111 includes a first transistor M1, a second transistor M2, a tenth transistor M10, a thirteenth transistor M13, and a fourteenth transistor M14.

A first electrode of the first transistor M1 is coupled to the first input terminal IN1 to which the scan start signal SSP or the first polarity scan signal nSC(n−2) of the (n−2)th first stage ST1*n*−2 is applied, and a second electrode of the first transistor M1 is coupled to the second driving node QB via a sixth transistor M6. A gate electrode of the transistor M1 is coupled to the second clock terminal CK2. The first transistor M1 is turned on when the first p-type clock signal pCLK1 is supplied to the second clock terminal CK2, to electrically couple the first input terminal IN1 to the second driving node QB.

The thirteenth transistor M13 and the fourteenth transistor M14 are coupled in series between the first power terminal V1 to which the first power source VGH is applied and the second power terminal V2 to which the second power source VGL is applied. A common node of the thirteenth transistor M13 and the fourteenth transistor M14 is referred to as a fourth node N4. The thirteenth transistor M13 is a p-type transistor, and the fourteenth transistor M14 is an n-type transistor.

A gate electrode of the thirteenth transistor M13 is coupled to the third input terminal IN3 to which the first polarity scan signal nSC(n−1) of the (n−1)th first stage ST1*n*-1. The thirteenth transistor M13 is turned on when a low voltage is supplied to the third input terminal IN3, to supply a high voltage to the fourth node N4.

A gate electrode of the fourteenth transistor M14 is coupled to the third input terminal IN3. The fourteenth transistor M14 is turned on when the high voltage is supplied to the third input terminal IN3, to supply the low voltage to the fourth node N4.

The second transistor M2 is diode-coupled between the fourth node N4 and the first node N1. The second transistor M2 may transfer a voltage of the fourth node N4 to a first driving node Q.

A first electrode of the tenth transistor M10 is coupled to the first input terminal IN1, and a second electrode of the tenth transistor M10 is coupled to the second node N2 via an eleventh transistor M11. A gate electrode of the tenth transistor M10 is coupled to the second clock terminal CK2. The tenth transistor M10 is turned on when the first p-type clock signal pCLK1 is supplied to the second clock terminal CK2, to electrically couple the first input terminal IN1 to the second node N2.

As described above, in the second exemplary embodiment, the first electrode scan signal nSC of a previous stage is inverted to be supplied to the fourth node N4, using the thirteenth transistor M13 and the fourteenth transistor M14, which constitute an inverter. The first stage ST1*a* shown in FIG. 11 has a configuration identical to that of the first stage ST1*n* shown in FIG. 5, except that a second electrode scan signal pSC of the previous stage is replaced with the first electrode scan signal nSC of the previous stage. Therefore, a detailed description of an operation of the first stage ST1*a* will be omitted to avoid redundancy.

Figure 12:
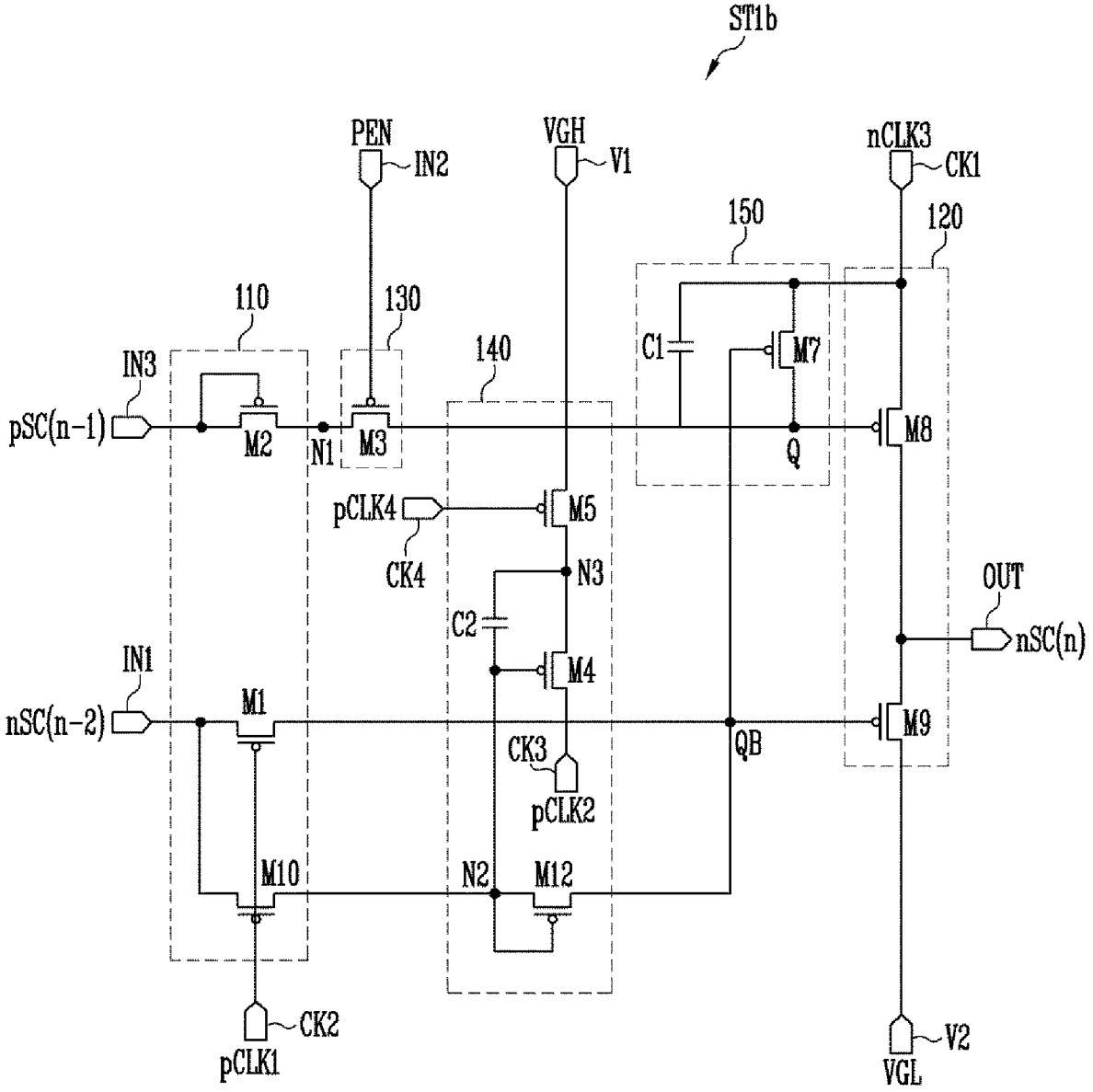
FIG. 12 is a circuit diagram of a third exemplary embodiment of the first stage shown in FIG. 3.

FIG. 12 is a circuit diagram of a third exemplary embodiment of the first stage shown in FIG. 3. In FIG. 12, components identical to those shown in FIG. 5 are designated by like reference numerals, and their detailed descriptions will be omitted to avoid redundancy.

Referring to FIGS. 3, 5, and 12, the first stage ST1*b* according to the third exemplary embodiment includes an input unit, an output unit 120, a first signal processor 130, a second signal processor 140, and a third signal processor 150.

In the third exemplary embodiment, the first stage ST1*b* has a configuration identical to that of the first stage ST1*n* shown in FIG. 5, except that the first and second stabilizers 161 and 162 are omitted. Therefore, a detailed description of an operation of the first stage ST1*b* will be omitted to avoid redundancy.

Figure 13:
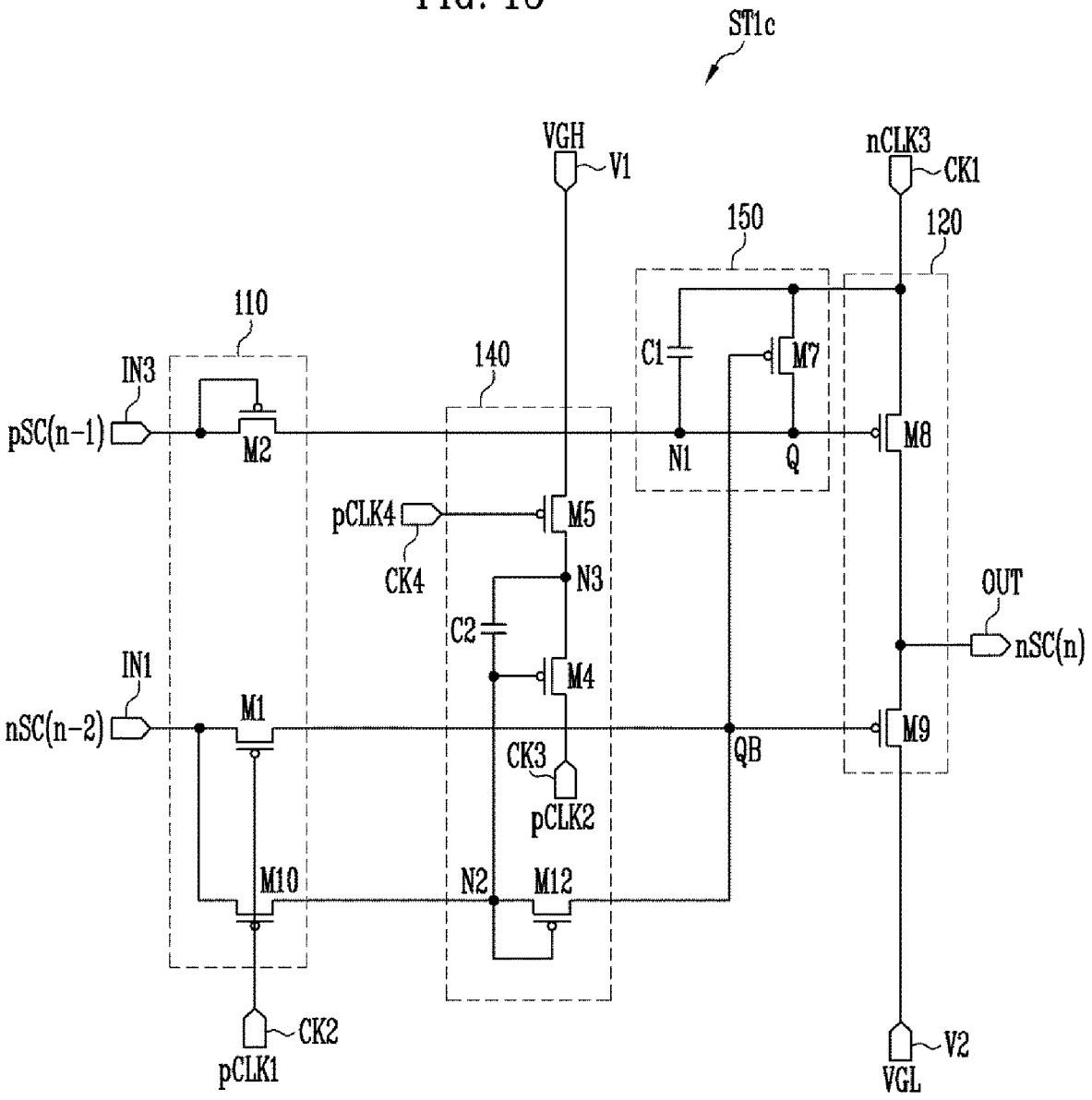
FIG. 13 is a circuit diagram illustrating a fourth exemplary embodiment of the first stage shown in FIG. 3.

FIG. 13 is a circuit diagram of a fourth exemplary embodiment of the first stage shown in FIG. 3. In FIG. 13, components identical to those shown in FIG. 5 are designated by like reference numerals, and their detailed descriptions will be omitted to avoid redundancy.

Referring to FIG. 13, the first stage ST1*c* according to the fourth exemplary embodiment includes an input unit 110, an output unit 120, a second signal processor 140, and a third signal processor 15.

In the fourth exemplary embodiment, the first stage ST1*c* has a configuration identical to that of the first stage ST1*n* shown in FIG. 5, except that the first signal processor 130 and the first and second stabilizers 161 and 162 are omitted. In this embodiment, the first stage ST1*c* does not perform a low frequency operation according to the control signal PEN, as compared with the first stage ST1*n* shown in FIG. 5.

Figure 14:
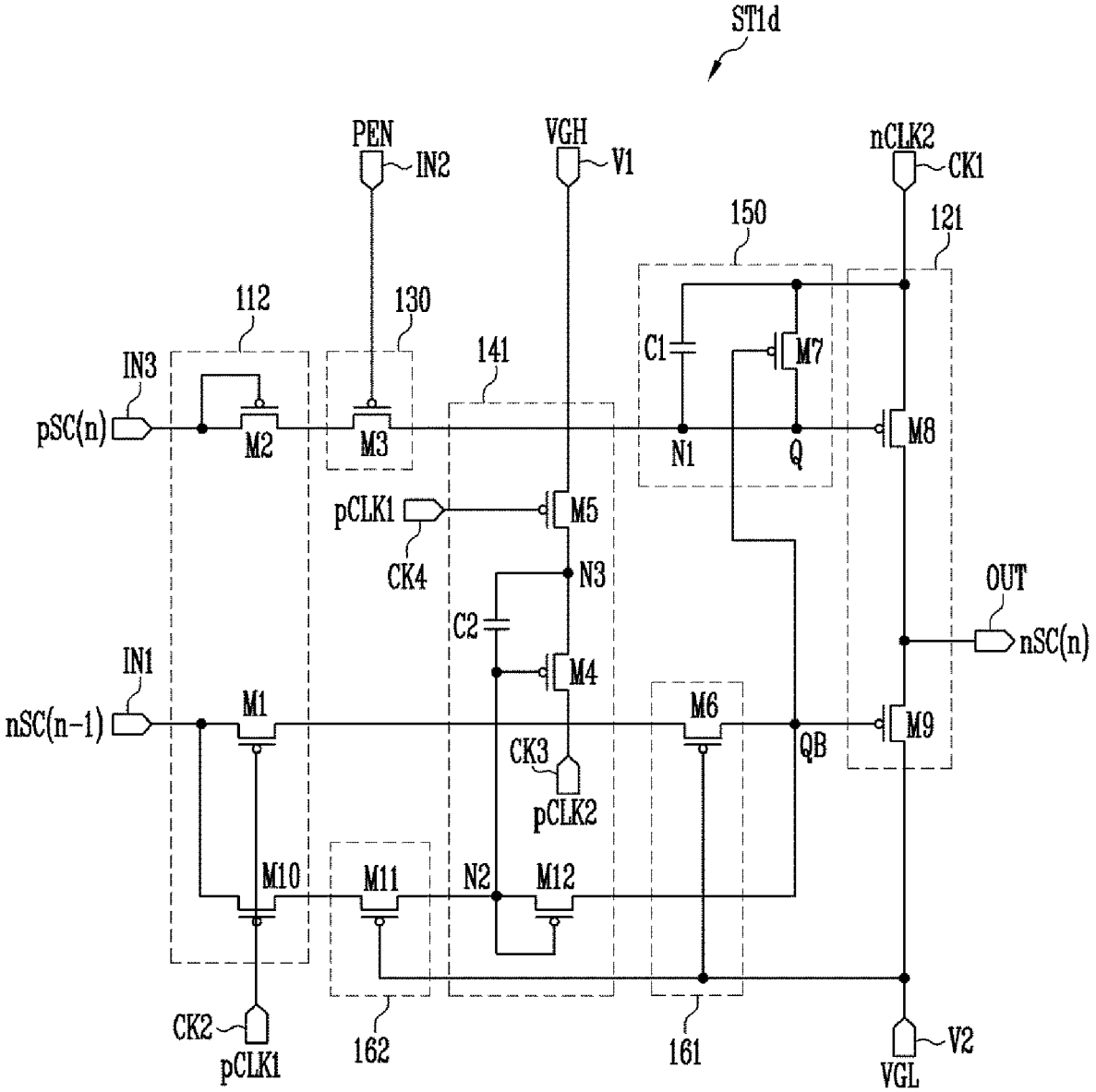
FIG. 14 is a circuit diagram illustrating a fifth exemplary embodiment of the first stage shown in FIG. 3.

FIG. 14 is a circuit diagram of a fifth exemplary embodiment of the first stage shown in FIG. 3. In FIG. 14, components identical to those shown in FIG. 5 are designated by like reference numerals, and their detailed descriptions will be omitted to avoid redundancy.

Referring to FIG. 14, the first stage ST1*d* according to the fifth exemplary embodiment includes an input unit 112, an output unit 121, a first signal processor 130, a second signal processor 141, a third signal processor 150, and first and second stabilizers 161 and 162.

The output unit 121 supplies the voltage of the first power source VGH or the second power source VGL to the output terminal OUT, corresponding to voltages of the first driving node Q and the second driving node QB. To this end, the output unit 121 includes an eighth transistor M8 and a ninth transistor M9.

The eighth transistor M8 is coupled between the first clock terminal CK1 to which the second n-type clock signal nCLK2 is applied and the output terminal OUT. In addition, a gate electrode of the eighth transistor M8 is coupled to the first driving node Q. The eighth transistor M8 is turned on or turned off corresponding to the voltage of the first driving node Q. The second n-type clock signal nCLK2 supplied to the output terminal OUT when the eighth transistor M8 is turned on is output as the first electrode scan signal nSC(n) of the nth scan line SCn (e.g., the nth first scan line SC1*n* and/or the nth second scan line SC2*n*).

The ninth transistor M9 is coupled between the output terminal OUT and the second power source VGL. In addition, a gate electrode of the ninth transistor M9 is coupled to the second driving node QB. The ninth transistor M9 is turned on or turned off corresponding to the voltage of the second driving node QB.

The input unit 112 controls voltages of a first node N1, a second node N2, and the second driving node QB in response to signals supplied to the first input terminal IN1, the third input terminal IN3, and the second clock terminal CK2. To this end, the input unit 112 includes a first transistor M1, a second transistor M2, and a tenth transistor M10.

A first electrode of the first transistor M1 is coupled to the first input terminal In1 to which the scan start signal SSP or the first polarity scan signal nSC(n−1) of the (n−1)th first scan stage ST1*n*-1 is applied, and a second electrode of the first transistor M1 is coupled to the second driving node QB via a sixth transistor M6. A gate electrode of the first transistor M1 is coupled to the second clock terminal CK2. The first transistor M1 is turned on when the first p-type clock signal pCLK1 is supplied to the second clock terminal CK2, to electrically couple the first input terminal IN1 to the second driving node QB.

The second transistor M2 is diode-coupled between the third input terminal IN3 to which the second polarity scan signal pSC(n) of the nth second stage ST2*n* is applied, and the first node N1. The second transistor M2 may transfer, to the first node N1, the second polarity scan signal pSC(n) of the nth second stage ST2*n*, which is supplied to the third input terminal IN3.

A first electrode of the tenth transistor M10 is coupled to the first input terminal IN1, and a second electrode of the tenth transistor M10 is coupled to the second node N2 via an eleventh transistor M11. A gate electrode of the tenth transistor M10 is coupled to the second clock terminal CK2. The tenth transistor M10 is turned on when the first p-type clock signal pCLK1 is supplied to the second clock terminal CK2, to electrically couple the first input terminal IN1 to the second node N2.

The second signal processor 141 is coupled to the second driving node QB, and controls the voltage of the second driving node QB in response to signals supplied to the third clock terminal CK3 and the fourth clock terminal CK4. To this end, the second signal processor 141 includes a fourth transistor M4, a fifth transistor M5, a twelfth transistor M12, and a second capacitor C2.

The fifth transistor M5 and the fourth transistor M4 are coupled in series between the first power terminal V1 to which the first power source VGH is applied and the third clock terminal CK3 to which the second p-type clock signal pCLK2 is applied. A common node of the fifth transistor M5 and the fourth transistor M4 is referred to as a third node N3.

A gate electrode of the fifth transistor M5 is coupled to the fourth clock terminal CK4 to which the first p-type clock signal p CLK1 is applied. The fifth transistor M5 is turned on or turned off corresponding to the signal supplied to the fourth clock terminal CK4.

A gate electrode of the fourth transistor M4 is coupled to the second node N2. The fourth transistor M4 is turned on or turned off corresponding to the voltage of the second node N2.

The twelfth transistor M12 is diode-coupled between the second node N2 and the second driving node QB. The twelfth transistor M12 may electrically couple the second node N2 to the second driving node QB in response to the voltage of the second node N2.

The second capacitor C2 is coupled between the third node N3 and the second node N2. The second capacitor C2 charges a voltage corresponding to the gate-on voltage of the fourth transistor M4.

In this embodiment, the first p-type clock signal pCLK1 and the second p-type clock signal pCLK2 may be replaced with a separate signal provided from the outside.

Figure 15:
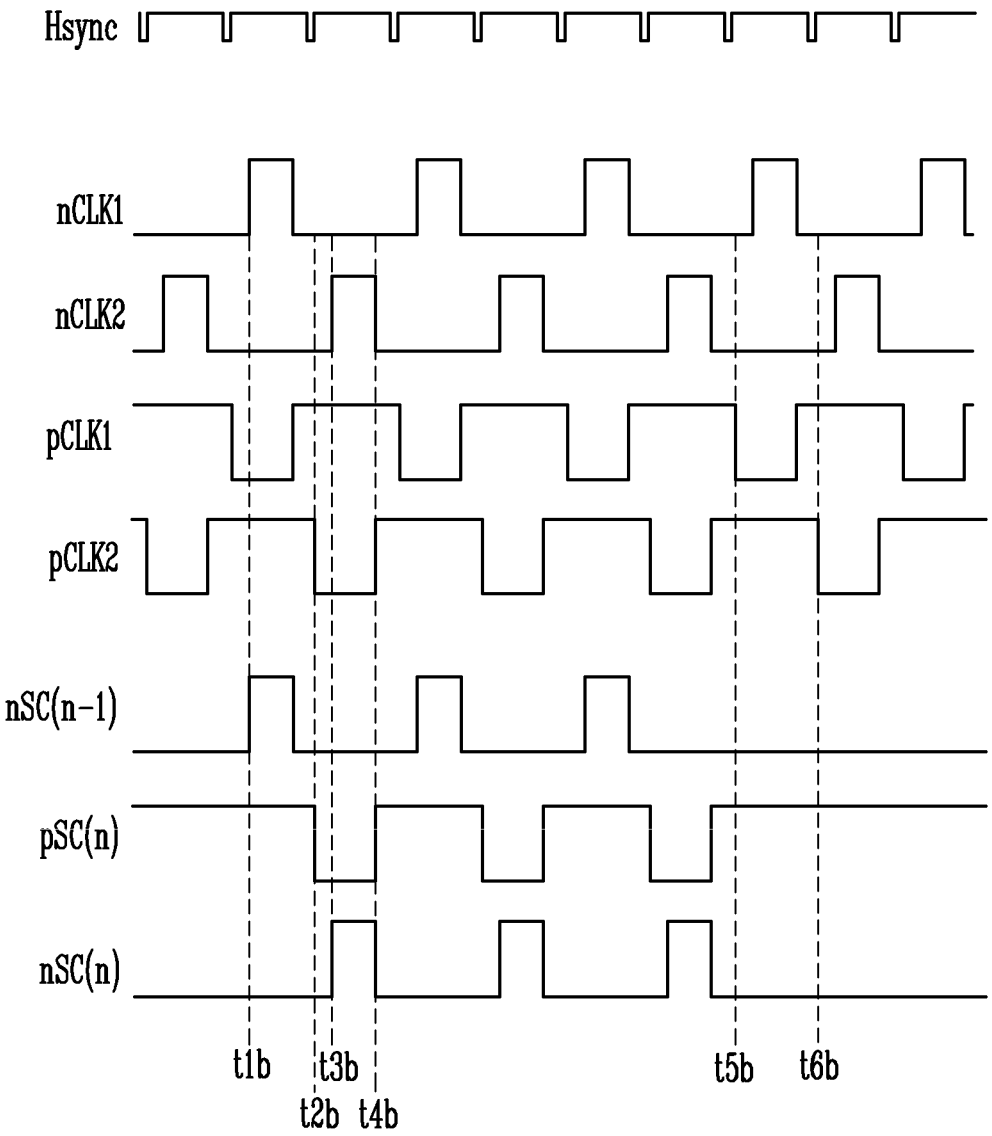
FIG. 15 is an exemplary timing diagram illustrating an exemplary driving method of the first stage shown in FIG. 14.

FIG. 15 is an exemplary timing diagram illustrating an exemplary driving method of the first stage shown in FIG. 14.

Referring to FIG. 15, pulses of the second n-type clock signals nCLK2 may have a polarity opposite to that of pulses of the second p-type clock signal pCLK2. The pulses of the second n-type clock signals nCLK2 may be generated during times at which the pulses of the second p-type clock signal pCLK2 are generated, and times at which the pulses of the second n-type clock signals nCLK2 are generated may be further delayed than those at which the pulses of the second p-type clock signal pCLK2 are generated.

Pulses of the first p-type clock signal pCLK1 may have a polarity opposite to that of the pulses of the second n-type clock signals nCLK2. The pulses of the first p-type clock signal pCLK1 may not temporally overlap with the pulses of the second n-type clock signals nCLK2.

The first power source VGH has a voltage of a high level, and the second power source VGL has a voltage of a low level. Therefore, in the driving method, the sixth transistor M6 of which the gate electrode is coupled to the first power source VGH is in the turn-on state, and therefore, a description of the transistor M9 will be omitted except a particular case.

The control signal PEN maintains the gate-on voltage. Therefore, the third transistor M3 maintains the turn-on state during high frequency driving.

First, at a 1bth time t1b, the first polarity scan signal nSC(n−1) of the (n−1)th first stage ST1*n*−1, which has the high level, is supplied.

Since the first transistor M1 is turned on by the first p-type clock signal pCLK1 of the low level, the (n−1)th first polarity scan signal nSC(n−1) of the high level is supplied to the second driving node QB. Therefore, the transistors M4, M9, and M12 of which the gate electrodes are coupled to the second driving node QB are turned off.

Since the second transistor M2 is in a state in which it is diode-coupled, the direction of current is toward the other electrode of the second transistor M2, which is a drain electrode, from one electrode of the second transistor M2, which is a source electrode. Therefore, at the 1bth time t1b, the second polarity scan signal pSC(n) of the high level is not transferred to the first driving node Q. Therefore, the first driving node Q1 maintains a voltage of a previous period.

At a 2bth time t2b, the second polarity scan signal pSC(n) of the low level and the second p-type clock signal pCLK2 of the low level are supplied.

Therefore, the voltage of the first driving node Q becomes the low level according to the second polarity scan signal pSC(n) of the low level, and the eighth transistor M8 is turned on. Accordingly, the second n-type clock signal nCLK2 of the low level is output as the first polarity scan signal nSC(n) of the low level.

Although the (n−1)th first polarity scan signal nSC(n−1) of the low level is supplied, the first transistor M1 is in the turn-off state due to the first p-type clock signal pCLK1 of the high level, and hence the voltage of the second driving node QB maintains the high level. Therefore, the ninth transistor M9 is in the turn-off state.

At a 3bth time t3b, the second n-type clock signal nCLK2 of the high level is supplied.

The eighth transistor M8 maintains the turn-on state, and the ninth transistor M9 maintains the turn-off state. Hence, the second n-type clock signal nCLK2 of the high level is output as the first polarity scan signal nSC(n) of the high level.

At a 4bth time t4b, the second n-type clock signal nCLK2 of the low level is supplied.

The eighth transistor M8 maintains the turn-on state, and the ninth transistor M9 maintains the turn-off state. Hence, the second n-type clock signal nCLK2 of the low level is output as the first polarity scan signal nSC(n) of the low level.

The voltage of the first driving node Q becomes lower than the low level due to coupling of the first capacitor C1. Thus, the eighth transistor M8 stably maintains the turn-on state, and driving characteristics can be improved.

At a 5bth time t5b, the first p-type clock signal pCLK1 of the low level is supplied.

Since the (n−1)th first polarity scan signal nSC(n−1) of the low level is supplied, the voltage of the second driving node QB becomes the low level. Therefore, the transistors M4, M7, and M9 of which the gate electrodes are coupled to the second driving node QB are turned on.

When the ninth transistor M9 is turned on, the voltage of the low level is output to as the first polarity scan signal nSC(n) of the low level.

When the seventh transistor M7 is turned on, the eighth transistor M8 is diode-coupled. Therefore, although the second n-type clock signal nCLK2 of the high level is subsequently supplied, the voltage of the high level is not output.

When the fourth transistor M4 is turned on, the second p-type clock signal pCLK2 of the high level is applied to one electrode of the second capacitor C2.

At a 6bth time t6b, the second p-type clock signal pCLK2 of the low level is supplied.

Since the fourth transistor M4 is in the turn-on state, the second p-type clock signal pCLK2 is supplied to the one electrode of the second capacitor C2, and the voltage of the second driving node QB becomes lower than the low level due to coupling of the second capacitor C2. Thus, the ninth transistor M9 stably maintains the turn-on state, and driving characteristics can be improved.

In the stage and the scan driver constructed according to the principles and exemplary embodiments of the invention, the scan driver can supply a scan signal to activate an N-type transistor.

Further, in the stage and the scan driver constructed according to the principles and exemplary embodiments of the invention, the stage prevents charging and discharging of a capacitor provided in the stage while a scan signal is maintaining a low voltage, so that the power consumption of the display device can be reduced.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A stage of a scan driver for a display device, the stage comprising:

an output unit to output to an output terminal either a signal supplied to a first clock terminal corresponding to voltage of a first driving node or a voltage of a second power source corresponding to voltage of a second driving node;

an input unit to control the voltage of the first driving node corresponding to signals supplied to a first input terminal, the input unit being configured to control the voltage of the second driving node corresponding to signals supplied to a second input terminal and a second clock terminal;

a first signal processor including a second capacitor coupled between the second driving node and a second node, the first signal processor to control the voltage of the second driving node corresponding to signals supplied to a third clock terminal and a fourth clock terminal and to control a potential difference between both ends of the second capacitor corresponding to the signal supplied to the fourth clock terminal; and a second signal processor to control the voltage of the first driving node corresponding to the signal supplied to the first clock terminal.

2. The stage of claim 1, wherein the input unit comprises:

a first transistor coupled between the second input terminal and the second driving node, the first transistor having a gate electrode coupled to the second clock terminal;

a second transistor diode-coupled between the first input terminal and the first driving node; and a third transistor coupled between the second input terminal and the first signal processor, the third transistor having a gate electrode coupled to the second clock terminal.

3. The stage of claim 2, further comprising a third signal processor coupled between the input unit and the first driving node to control the voltage of the first driving node.

4. The stage of claim 3, wherein the third signal processor comprises a fourth transistor coupled between the second transistor and the first driving node, the fourth transistor having a gate electrode coupled to a third input terminal being operable to receive a control signal.

5. The stage of claim 4, wherein the control signal is supplied as a gate-on voltage of the fourth transistor during a high frequency driving mode, and is supplied as a gate-off voltage of the fourth transistor in at least one frame to perform bias during a low frequency driving mode.

6. The stage of claim 3, further comprising:

a first stabilizer coupled between the first signal processor and the second driving node, the first stabilizer controlling a voltage drop of the second driving node; and a second stabilizer coupled between the input unit and the first signal processor, the second stabilizer controlling a voltage drop of a first node in the first signal processor.

7. The stage of claim 6, wherein the first stabilizer comprises a fifth transistor coupled between the first transistor and the second driving node, the fifth transistor having a gate electrode operable to receive voltage from the second power source.

8. The stage of claim 6, wherein the second stabilizer comprises a sixth transistor coupled between the fifth transistor and the first node, the sixth transistor having a gate electrode operable to receive voltage from the second power source.

9. The stage of claim 1, wherein the input unit comprises:

a first transistor coupled between the second input terminal and the second driving node, the first transistor having a gate electrode coupled to the second clock terminal;

a second transistor diode-coupled between a second node and the first driving node;

a third transistor coupled between the second input terminal and the first signal processor, the third transistor having a gate electrode coupled to the second clock terminal;

a seventh transistor coupled between a first power source and the second node, the seventh transistor having a gate electrode coupled to the first input terminal; and an eighth transistor coupled between the second node and the second power source, the eighth transistor having a gate electrode coupled to the first input terminal, wherein the seventh transistor is a p-type transistor, and the eight transistor is an n-type transistor.

10. The stage of claim 2, wherein the output terminal is operable to output a scan signal having a first polarity, the second input terminal is operable to receive the first polarity scan signal of a previous stage, and the first input terminal is operable to receive a scan signal of the previous stage having a second polarity, wherein the first polarity and the second polarity are opposite to each other.

11. The stage of claim 1, wherein the first signal processor further comprises:

a ninth transistor coupled between the first power source and a third node, the ninth transistor having a gate electrode coupled to the fourth clock terminal;

a tenth transistor coupled between the third node and the third clock terminal, the tenth transistor having a gate electrode coupled to a first node;

a eleventh transistor diode-coupled between the first node and the second driving node; and a first capacitor coupled between the first node and the third node, the potential difference between the ends of the second capacitor being controllable according to the signal supplied to the fourth clock terminal.

12. The stage of claim 11, wherein the potential difference between the ends of the first capacitor is maintained substantially constant while the voltage of the second power source is being output to the output terminal.

13. A scan driver including a plurality of stages to supply a scan signal to scan lines of a display device, the scan driver comprising:

a first stage array having a plurality of first stages to provide scan signals of a first polarity to scan lines; and a second stage array having a plurality of second stages to provide scan signals of a second polarity to scan lines, wherein at least one of the first stages comprises:

an output unit to output to an output terminal either a signal supplied to a first clock terminal corresponding to voltage of a first driving node or a voltage of a second power source corresponding to voltage of a second driving node;

an input unit to control the voltage of the first driving node corresponding to signals supplied to a first input terminal, and the input unit being configured to control the voltage of the second driving node corresponding to signals supplied to a second input terminal and a second clock terminal;

a first signal processor including a second capacitor coupled between the second driving node and a second node, the first signal processor to control the voltage of the second driving node corresponding to signals supplied to a third clock terminal and a fourth clock terminal and to control a potential difference between both ends of the second capacitor corresponding to the signal supplied to the fourth clock terminal; and a second signal processor to control the voltage of the first driving node corresponding to the signal supplied to the first clock terminal.

14. The scan driver of claim 13, wherein the input unit comprises:

a first transistor coupled between the second input terminal and the second driving node, the first transistor having a gate electrode coupled to the second clock terminal;

a second transistor diode-coupled between the first input terminal and the first driving node; and a third transistor coupled between the second input terminal and the first signal processor, the third transistor having a gate electrode coupled to the second clock terminal.

15. The scan driver of claim 14, further comprising a third signal processor coupled between the input unit and the first driving node to control the voltage of the first driving node.

16. The scan driver of claim 15, wherein the third signal processor comprises an fourth transistor coupled between the second transistor and the first driving node, the fourth transistor having a gate electrode coupled to a third input terminal which is operable to receive a control signal.

17. The scan driver of claim 16, wherein the control signal is supplied as a gate-on voltage of the fourth transistor during high frequency driving mode, and is supplied as a gate-off voltage of the fourth transistor in at least one frame to perform bias during low frequency driving mode.

18. The scan driver of claim 15, further comprising:

a first stabilizer coupled between the first signal processor and the second driving node, the first stabilizer being operable to control an amount of a voltage drop of the second driving node; and a second stabilizer coupled between the input unit and the first signal processor, the second stabilizer being operable to control an amount of a voltage drop of a first node in the first signal processor.

19. The scan driver of claim 18, wherein the first stabilizer comprises a fifth transistor coupled between the first transistor and the second driving node, the fifth transistor having a gate electrode supplied voltage of the second power source, and the second stabilizer comprises a sixth transistor coupled between the fifth transistor and the first node, the sixth transistor having a gate electrode operable to receive voltage from the second power source.

20. The scan driver of claim 13, wherein the input unit comprises:

a first transistor coupled between the second input terminal and the second driving node, the first transistor having a gate electrode coupled to the second clock terminal;

a second transistor diode-coupled between a second node and the first driving node;

a third transistor coupled between the second input terminal and the first signal processor, the third transistor having a gate electrode coupled to the second clock terminal;

a seventh transistor coupled between a first power source and the second node, the seventh transistor having a gate electrode coupled to the first input terminal; and an eighth transistor coupled between the second node and the second power source, the eighth transistor having a gate electrode coupled to the first input terminal, wherein the seventh transistor is a p-type transistor, and the eight transistor is an n-type transistor.

* * * * *